US005079981A

United States Patent [19]

Singer et al.

[11] Patent Number: 5,079,981

[45] Date of Patent: Jan. 14, 1992

[54] CUTTER MECHANISM

[75] Inventors: Karl Singer, Barrington; Michael D. Flasza, Schaumburg, both of Ill.

[73] Assignee: D&K Custom Machine Design, Inc., Elk Grove Village, Ill.

[21] Appl. No.: 651,431

[22] Filed: Feb. 6, 1991

Related U.S. Application Data

[63] Continuation-in-part of Ser. No. 271,054, Nov. 14, 1988, abandoned.

[51] Int. Cl.[5] ..... B26D 5/20

[52] U.S. Cl. ..... 83/72; 83/216; 83/365; 83/368

[58] Field of Search ..... 83/72, 215, 216, 360, 83/364, 365, 368, 370

[56] References Cited

U.S. PATENT DOCUMENTS

| | | | |
|---|---|---|---|
| 3,197,353 | 7/1965 | Williams et al. | 83/365 |
| 3,407,690 | 10/1968 | Stanley | 83/371 |
| 4,475,422 | 10/1984 | Lawson | 83/368 |
| 4,541,317 | 9/1985 | Van Humbeeck et al. | 83/72 |
| 4,697,485 | 10/1987 | Raney | 83/216 |
| 4,794,962 | 1/1989 | Knudson | 83/368 |

*Primary Examiner*—Hien H. Phan

*Attorney, Agent, or Firm*—Wallenstein, Wagner & Hattis, Ltd.

[57] ABSTRACT

Apparatus for cutting the leading and trailing edges of an opaque sheet angling initially at an offset angle with respect to a cutting blade includes a pair of light sources and a pair of light sensors opposite said light sources. An opaque sheet to be cut is moved at right angles to a line extending between said pairs of light source and sensors to bring said article edges to and past said pairs of light sources and sensors. The sensors produce article edge angle indicating signals which indicate the time difference each edge reaches said pair of sensors. Means are provided responsive to said signals which adjust the blade angle to be parallel to each article edge so the blade cuts parallel to each edge. The angle indicating could be signals which are a direct measure of the difference in times each edge reaches the sensors. However, they are preferably derived from sensors measuring the relative amounts of light at a snapshot time passing through slots partially covered to different degrees by the sheet edge portion involved when the edge being measured is at an angle to said line.

8 Claims, 11 Drawing Sheets

Fig. 5
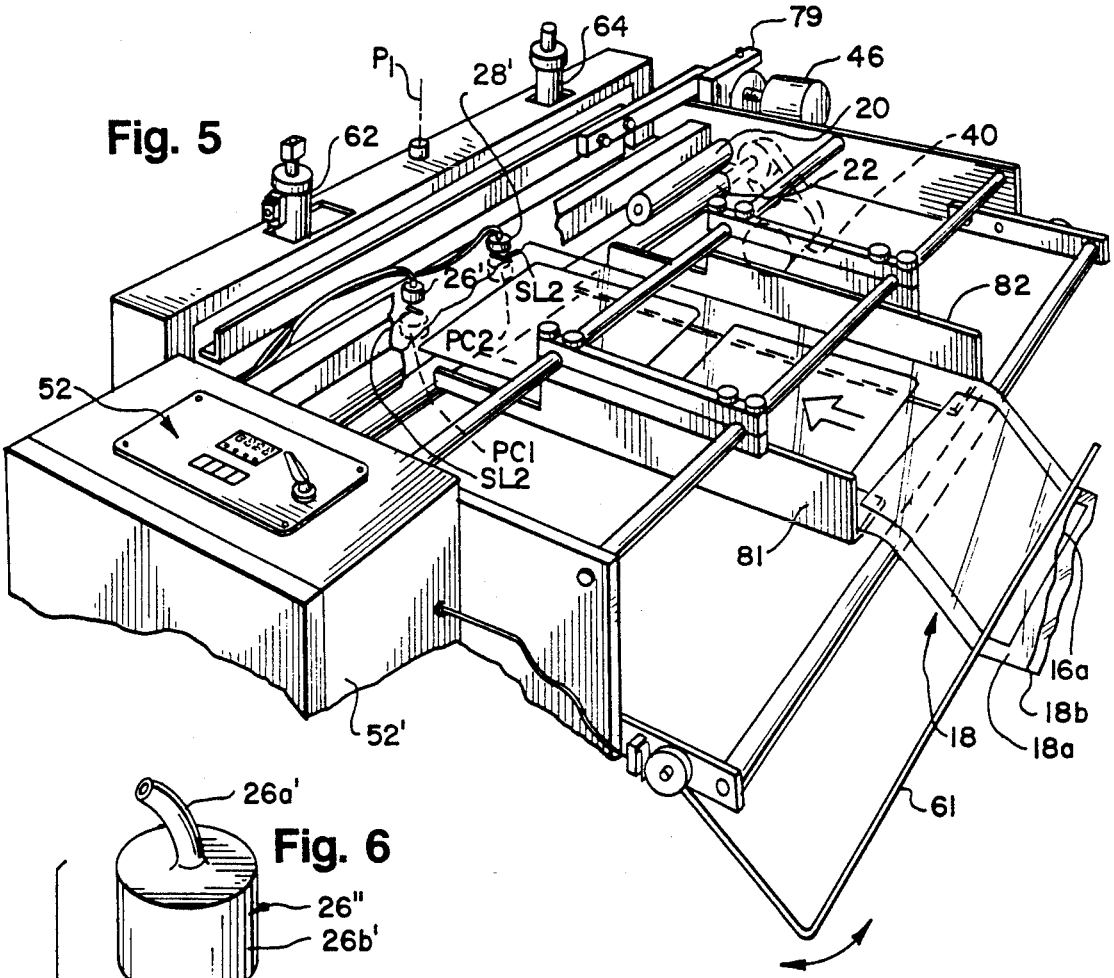
Fig. 6
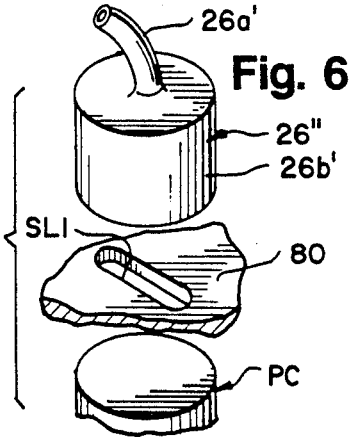
Fig. 7
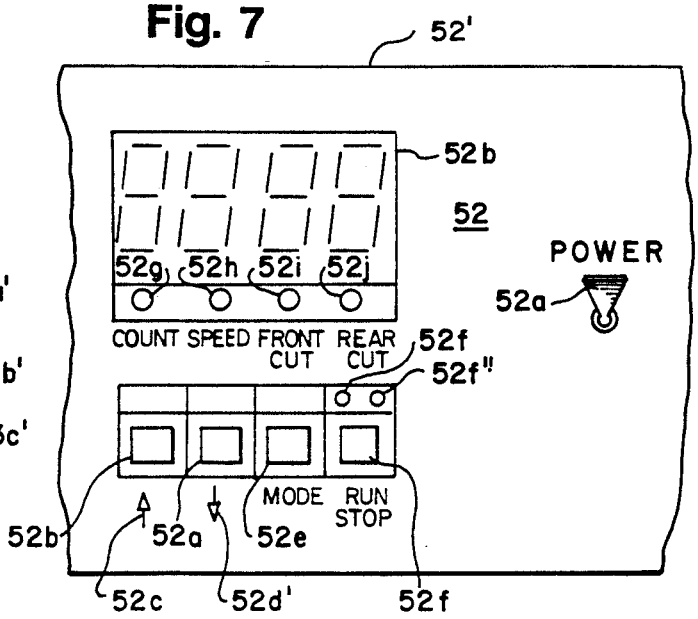
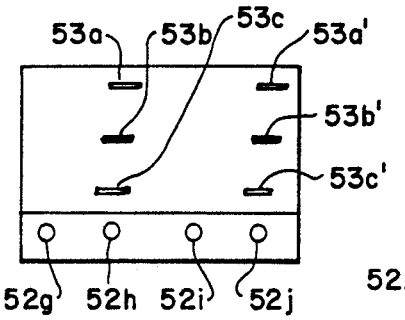
Fig. 7A

Fig. 8
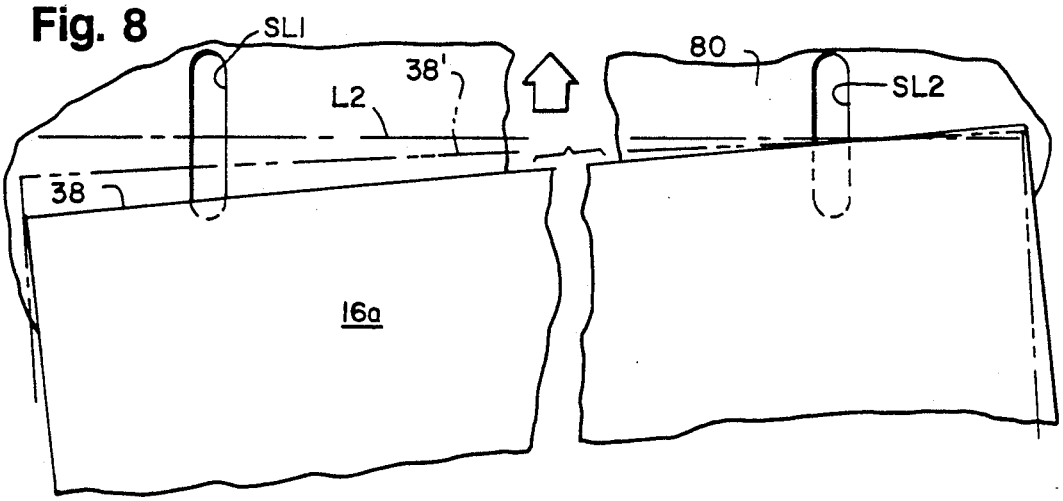
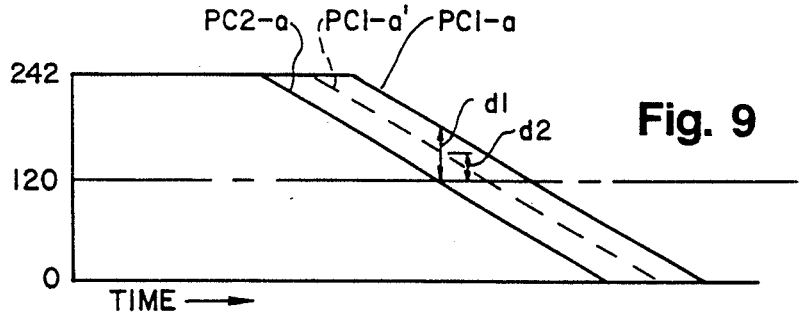
Fig. 9
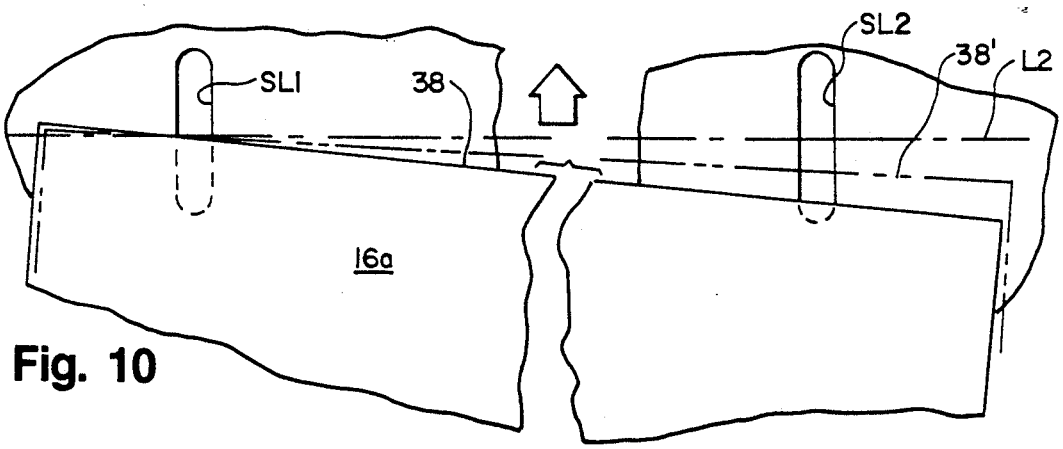
Fig. 10
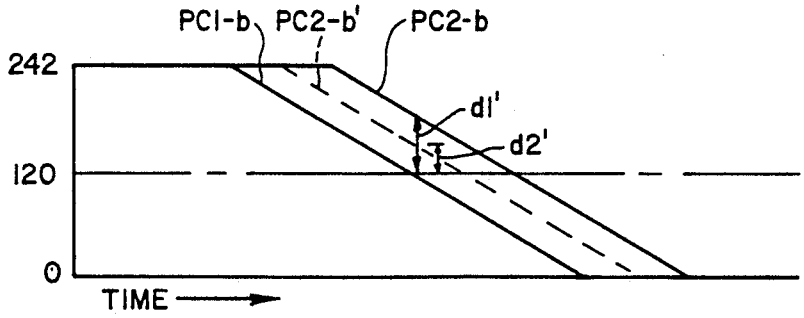
Fig. 11

CUTTER MECHANISM

RELATED APPLICATION

This application is a continuation-in-part of application Ser. No. 07/271,054, filed Nov. 14, 1988, now abandoned.

TECHNICAL FIELD

The present invention has its most important application to a laminated sheet trimmer having a pivotable cutting blade used to sequentially cut the leading and trailing edges of opaque sheets laminated between transparent continuous webs as they are stepped in position past the blade. The angle of the blade is automatically adjusted to cut the laminated sheets along these edges, despite the slightly varying angles of these edges. However, certain aspects of the invention have a broader application to the measurement of the offset angles of the straight edges of articles relative to the edges or other reference lines on other apparatus or articles and to the relative positioning of the straight edges of the articles in response to such measurement, so that the article edges have a parallel or other predetermined relationship to the edges or other reference lines on such apparatus or articles. For example, the broader aspects of the invention can be used to orient and apply labels in parallelism to the edges of articles to which they are applied.

BACKGROUND OF THE INVENTION

The use of laminating machines to apply laminate material to such items as menus, place mats, and the like for their protection and increased durability has been common practice for many years. In the mass production of such articles, generally opaque sheets having artistic or informational indicia thereon are laminated between continuous webs usually made of transparent material. In some instances, the borders or margins of the successive sheets are in abutment forming a continuous web of abutting laminated sheets. In other instances, the leading and trailing edges of the opaque sheets are separated from each other by the transparent laminate web material. The present invention applies to the latter web format. Cutting and trimming machines using cutting blades are used to slit such laminated web material along the leading, trailing and side edges of the laminated sheets to separate the individual sheets from the transparent web material to which they are laminated.

Some prior art machines use the opacity of the articles and the transparency of the laminate web material between the sheets to trigger a cutting operation. A single light source and a single light sensor device are placed on opposite sides of the continuous webs of laminated material. Preferably, the light source and light sensor device are placed at a location proximate to the cutting blade.

When the opaque sheets pass between the light source and light sensor, the light beam is interrupted. The passage of the leading edge of a sheet between the light source and sensor initiates such interruption. the passage of the trailing edge thereof terminates such interruption. Either transition can trigger an electronic control device to time control the cutting action of a punch or blade at an appropriate time to sever the leading and trailing edges of the sheets from the rest of the laminate web material.

It is obviously aesthetically preferable that the cutting operation be along and parallel to the edges of the sheets either in alignment with the edges or slightly outward or inward thereof if trimming is desired. This requires the leading and trailing edges of the sheets to be parallel to the cutting blade which cuts along the leading and trailing edges of the sheets. Frequently, the leading and trailing edges of the sheets are at small angle to the cutting blade so that the edges of the laminated sheets have an unattractive uneven appearance.

The prior art has utilized light sources and photocell sensors to vary the lateral and rotational position of an article severing means, like a punch, to properly align the edges of the punch and the article. U.S. Pat. No. 4,541,317 is an example of this prior art. However, the prior art photocell system for automatically positioning the cutting device relative to the straight edges of the article to be severed from the webs have left much to be desired from the standpoint of ease of operation and adjustment of these systems and the reliability and accuracy of the cutting operation.

SUMMARY OF THE INVENTION

In accordance with the laminate article cutting device application of the invention, the apparatus, as in the case of the above described prior art cutting devices, includes means for advancing the laminated webs and controlling the angle of the cutting edge of the blade to be parallel to the angled leading and trailing edges of opaque laminated sheets spaced along the transparent laminating web body. Where the cutting device is a blade which severs the leading and trailing edges of each opaque sheet, the side edges thereof are severed as a separate operation prior to subsequent to the severance of the leading and trailing edges thereof as described herein.

Two different unique techniques are disclosed herein for sensing the incident angle of the leading and trailing edges of each sheet and then rotating the cutting blade so it is parallel thereto. Both respond to differences in the times when the leading and trailing edges of each sheet reach two light sources spaced transversely of the direction of movement of the laminating web body.

One technique is a time measurement technique where a pair of light sources and corresponding sensors spaced apart along a reference line transverse to the direction of web movement operate in an On/Off (Clear/Dark) mode. A measurement of the time difference between the passage of an article edge past the two sensors indicates the edges angle. The laminating webs are "stepped" forward by a stepper motor in discrete increments, to bring successive sheets first past the light sources and their sensors and then to the cutting blade. A microprocessor counts the number of steps between the times when each sensor detects a transition from a clear to a dark or from a dark to a clear mode. For a given distance between the light sources and the number of fixed steps of web advancement which occurs between the times of passage of an article edge past the two sensors, and the identity of the sensor which first senses such a transition, the magnitude and direction of the sheet edge angle, if any, relative to a line between the sensors is determined. In response to this measurement, the blade angle is adjusted to bring the blade edge parallel to the sheet edge involved just prior to a cutting operation.

While this technique is fairly simple, it has the major disadvantage that the resolution (the smallest angle increment that can be calculated) is limited by the step distance that the sheet is advanced during the measurement. The best resolution requirements call for step distances much smaller than the machine would otherwise need to avoid limiting its speed.

Practical machine speeds are accomplished with step lengths of approximately 0.01" per step. This limits the resolution of digital sensing to 0.01" per 6" of sheet width, if the light sources and sensors are spaced apart 6", which would be required to process small (less than 8" width) sheets. This means that when large (say, 24" sheets) are to be cut, angle errors of up to 0.040" may remain in the final cut. Experimental results showed that over a 24" sheet, angle correction needed to be much better than 0.010" to be visually acceptable, with 0.005" correction even better. This means that a practical angle measurement system had to be found with approximately ten times better resolution than that offered by the digital sensing system with 0.01" steps. A 0.001" stepping is not practical due to the severe limitation it would place on machine speed.

The preferred technique is an analog light intensity measuring rather than a step-counting sensing technique. This allows greater resolution in the angle measurement, while not involving the step length of the motor in the equation. Analog sensing starts by inserting between the light sources and their sensors "slots" of known length, separated by a given distance along a line transverse to the direction of web step movement. Now, however, instead of responding with a digital (ON or OFF only) signal, the sensor circuitry produces a progressively varying voltage level indicative of what proportion of the associated slot is actually covered or uncovered by the edge at a particular instant of time. That is, when the slot is fully uncovered, a DC voltage corresponding to a reference "100%" light intensity condition is produced, and when a slot is fully covered, a "0%" output condition is produced thereby. As the sheet progressively steps over the slot, a "curve" is traced out by the analog voltage output of each sensor whose value is an indicator of what part of the slot is "covered" at that moment.

This analog voltage has no resolution limit as with the digital system. By having dual slots separated by a given distance, the phase and amplitude differences between the two analog voltages at any instant of time when both slots are partially covered indicates the direction and magnitude of the sheet edge angle. The machine's microprocessor only needs to take a "snapshot" of the sensors output at any point in time when both sensors are partly covered. A calculation of the sheet edge angle is then straight forward, except for errors introduced by differences in the strengths of the light source or sheet opacity variables. The microprocessor preferably converts the analog sensor output to digital data by an analog-to-digital converter and the digital result is stored. A calculation is carried out by the microprocessor involving a comparison (i.e. a subtraction) of the stored digital snapshot values to determine the direction and number of times a blade rotating step motor must be stepped to bring the blade parallel to the sheet edge involved. Since the analog measuring system has now been divorced from the step length of the machine's web feeding means, the web feeding step length does not affect the cutting angle accuracy.

In summary, the principle of analog sensing is to step the leading or trailing edge of a sheet past a pair of slots which have analog voltage outputs determined by what percent they are "covered" by the sheet. The difference in the analog voltage outputs of the light sensors, also referred to as "eyes", is a measurement of the incident angle as long as a "snapshot" of the eye outputs is taken when both slots are partly covered. The difference voltage can be digitized into 8 or more bits of digital data, as required, to allow a high-resolution angle calculation.

In an ideal "web", the plastic laminate used to form the web would be perfectly clear (i.e. have a light transmission of 100%) and the sheet would be perfectly opaque (i.e. have light transmission of 0%). In the real world, this is not the case. Laminates exist with transmissions of 30 to 90%, and the sheets themselves can have transmissions of 15% or more. When passed under an analog sensor, the absolute voltage levels themselves can no longer be used directly to calculate the absolute position of a sheet edge since the voltage levels of 0% and 100% will not always be obtained. Also, analog circuits are subject to "drift" from temperature, time, etc. which render the task even more difficult, so that these problems pose a significant threat to the practicality of analog sensing. How, in the face of analog circuit drift and the use of varying sheet and laminate materials, could such a system be counted upon to produce accurate, repeatable position sensing down to 0.001"? The answer lies in the fact that all the required information is still available for an angle calculation. It is just a bit more trouble to obtain than in the ideal case. In accordance with another aspect of the invention, an algorithm is provided for cancelling the non-idealitities by a "normalization" routine in the preferred manner to be explained.

Other aspects of the invention include storing data on the last blade position angle, and comparing this data with the slot sensor desired computer blade sensing data, so that a blade rotation operation is carried out only when a change in blade position is required from its last adjusted position.

The manner in which the invention measures the angle of an article edge relative to a line between a pair of sensors is useful in applications other than cutter applications. It applies where article edge positioning relative to any reference line is desired.

BRIEF DESCRIPTION OF THE DRAWINGS

FIG. 5 is a perspective view of a cutter apparatus designed in accordance with the most preferred form of the invention, wherein the angle of the leading and trailing edges of an opaque sheet is determined by a snapshot time comparison of the different amounts of light passing through a pair of elongated slots interposed between a pair of light sources and sensors at said time when a leading or trailing edge portion of the sheet partially covers or uncovers said slots;

FIG. 6 is a fragmentary perspective view of one of said pairs of light source and light sensors of the apparatus of FIG. 5, where one of the slots of a slotted plate is interposed between one of said light source and light sensor and the entire slot is radiated evenly by the light source;

FIG. 7 is a plan view of the indicating screen and control panel of the control box of the apparatus shown in FIG. 5;

FIG. 7A illustrates a bar graph display on said screen which indicates than an initial maximum light intensity control adjustment has been properly made when the apparatus is prepared for operation;

FIG. 8 is a plan view showing the leading edge of an opaque sheet in a transparent laminating web body, broken away to show the sheet most clearly, the leading edge of that sheet being angled in a counterclockwise direction with respect to a center line between the pair of elongated slots shown in FIG. 5, and when the leading edge portion of the sheet is in a "snapshot" position where one-half of the right slot is intercepted by the sheet and a lesser amount of the other slot is intercepted thereby;

FIG. 9 shows two solid line curves representing the analog outputs of the two light sensors sensing the passage of light through the two slots shown in FIG. 8 as the angled leading edge portion of the opaque sheet shown in as a solid line in FIG. 8 progressively steps along the length of the two slots, and a curve shown as a dashed line representing the progressively changing output of the light sensor associated with the left slot in FIG. 8 for an opaque sheet having the lesser angled leading edge orientation shown as a dashed line in FIG. 8;

FIG. 10 is a view corresponding to FIG. 8 when the leading edge portion of an opaque sheet having the solid and dashed line orientations shown therein which angle in the opposite direction from that shown in FIG. 8 are partially intercepting the pair of slots shown therein when the sheet is in said "snapshot" position;

FIG. 11 shows two solid line curves representing the analog outputs of the two light sensors sensing the passage of light through the two slots shown in FIG. 10, as the angled leading edge portion of the opaque sheet shown as a solid line therein progressively steps along the length of the two slots, and a curve shown as a dashed line representing the progressively changing output of the light sensor associated with the right slot in FIG. 10 for an opaque sheet having a lesser angled dashed line leading edge portion orientation shown as a dashed line in FIG. 10.

DETAILED DESCRIPTION OF PREFERRED EMBODIMENTS OF INVENTION

FIGS. 1-4 Digital or Time Measuring Embodiments of the Invention

Figure 1:
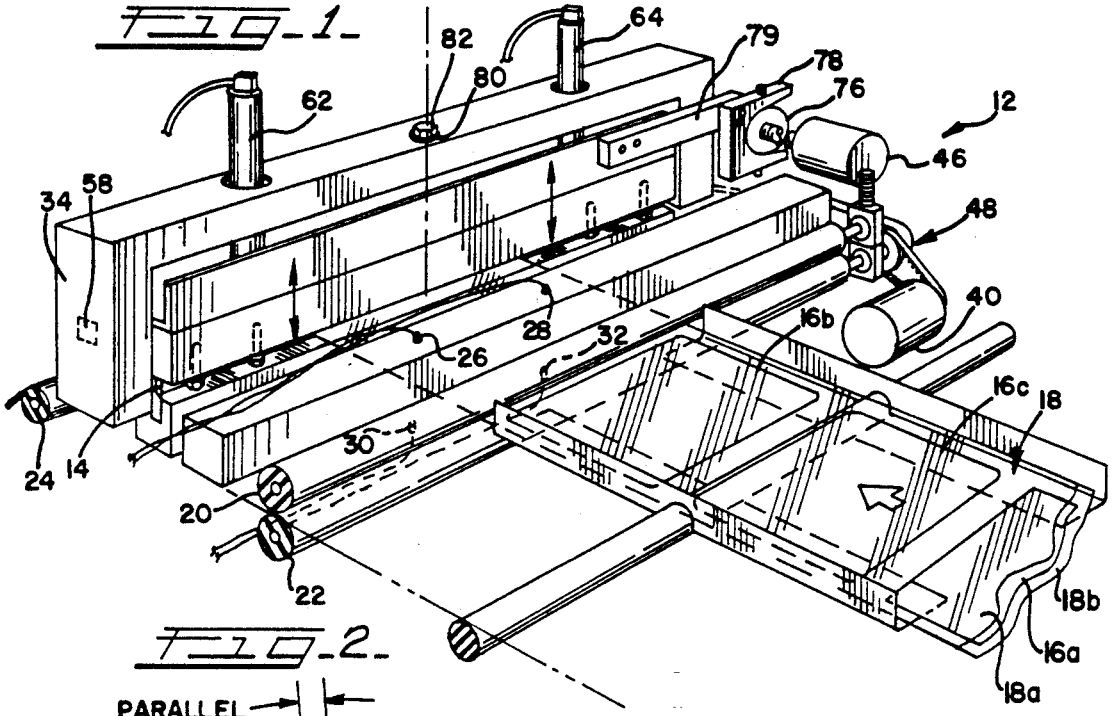
FIG. 1 is perspective view of an apparatus in accordance with a less preferred embodiment of the invention where the angle of the leading and trailing edges of an opaque sheet is determined by measuring the time difference that a pair of light beams aligned transversely of the direction of movement of the sheet are covered and uncovered by movement of said edges to and past such beams.

Referring now to the drawings, and particularly to FIG. 1, the apparatus in accordance with the invention is labeled with the reference numeral 12. This apparatus provides for parallel cutting of the laminated edge of a previously laminated article in a manner to be described.

The apparatus includes a cutting blade 14 oriented substantially perpendicularly to the path of movement of the laminated opaque sheets 16*a*, 16*b*, 16*c*, etc. (FIG. 2) as they pass under that blade. As may be seen, the sheets 16*a*, 16*b*, 16*c*, are laminated between upper and lower transparent webs 18*a*—18*a* to form a single, continuous integral laminate web body 18. The webs may be made of a suitable synthetic plastic material.

Referring again to FIG. 1, the apparatus also comprises means for advancing the laminate body 18 to and beyond the blade 14. Here, that means includes a pair of drive rollers 20 and 22 upstream of the cutting blade 14, and an idler roller 24 downstream of the blade 14. The drive rollers 20 and 22 are all indirectly driven by a step motor, as will be described later.

In the present embodiment, rollers 20, 22 are driven by a step motor 40 which may be a type 34T2BEHD, model no. 2434, manufactured by Bodine Electric Company. This motor, without accompanying motor drives that are provided with this embodiment, may be geared for 200 steps per revolution.

A pair of sensing means for determining the extent of deviation of the leading and trailing edge of each sheet from parallelism with the cutting edge 36 of the cutting blade 14. Particularly, these sensing means comprise at least one pair of infrared light beam sources 26 and 28 and a pair of corresponding light sensors 30 and 32.

In the preferred embodiment, each of the infrared light beam sources 26 and 28 are secured within a frame 34, and are disposed on one side of the plane of the laminate web body 18. A reference line between the centers of those beam sources 26 and 28 is transverse to the direction of movement of the laminate body 18 and parallel to the cutting edge 36 (FIG. 3) of the cutting blade 14, when that blade is in a "zero" or "reference" position. Each of the sensors 30 and 32 are secured to another portion of the frame 34. The part of the frame to which the sensors 30 and 32 are secured is separated by the plane of the laminate body 18 from the part of the frame to which the light beam sources 26 and 28 are secured.

As indicated above, light from these light beam sources 26 and 28 will be detected by sensors 30 and 32 when the transparent portion 54 of the laminate web body 18 (FIG. 2) between the sheets (e.g., 16*a* and 16*b*) is disposed directly between the beam sources and sensors. In contrast, when an opaque sheet passes between the beam sources and the sensors, the light beams are interrupted, i.e., no light reaches the sensors.

When the leading edge 38 of sheet 16*a* is perfectly parallel with the cutting edge 36 of the blade 14 in the "zero" or "reference" position, the leading edge 38 will interrupt the beam of light from beam source 26 at precisely the same time as it interrupts the beam of light from beam source 28 to sensor 32. However, in the event that the leading edge 38 of sheet 16*a* is somewhat offset from perfect parallelism with the reference line between the beam sources, one of the light beams will be interrupted sooner than the other. It is this difference in the time of light beam interruption that triggers the mechanisms rotating the cutting blade 14.

The greater the difference in the time of light beam interruption, the greater the offset of the leading edge 38 from parallelism with this reference line. The extent of this offset is measured by the step motor 40 which drives the drive rollers 20 and 22.

Figure 2:
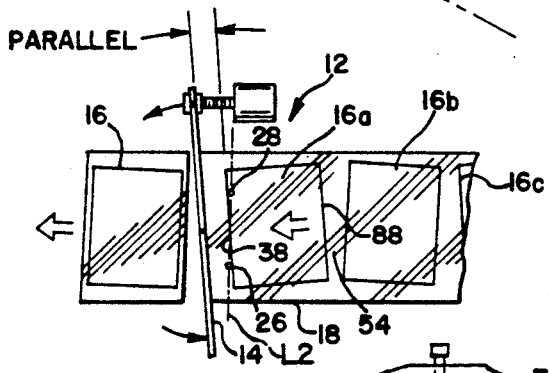
FIG. 2 is a top view of the invention of FIG. 1, and showing an article being transported through the apparatus.

Referring now to FIG. 2, this Figure depicts a sheet article 16*a* that is offset from perfect parallelism with the blade 14 in the "zero" position. The extent of offset depicted in this Figure is exaggerated for purposes of this description. As the drive rollers 20 and 22 move the laminate web body towards the blade 14, the beam of light provided by infrared light beam 28 to light detector 32 is interrupted by the leading edge 38 of article 16*a*. The light beam from infrared light beam 26 to light detector 30 is not interrupted, however, until the drive rollers 20 and 22 move the article 16*a* somewhat further ahead. As the step motor 40 revolves through one step, article 16*a* is moved forward 0.010" (ten-thousandths of an inch) in the present embodiment.

A signal from this step motor 40 is sent to a second component of the system now being described, the electronic feedback means, for each "step" moved by the motor 40 in the time interval between the interruption of these respective beams.

Figure 4:
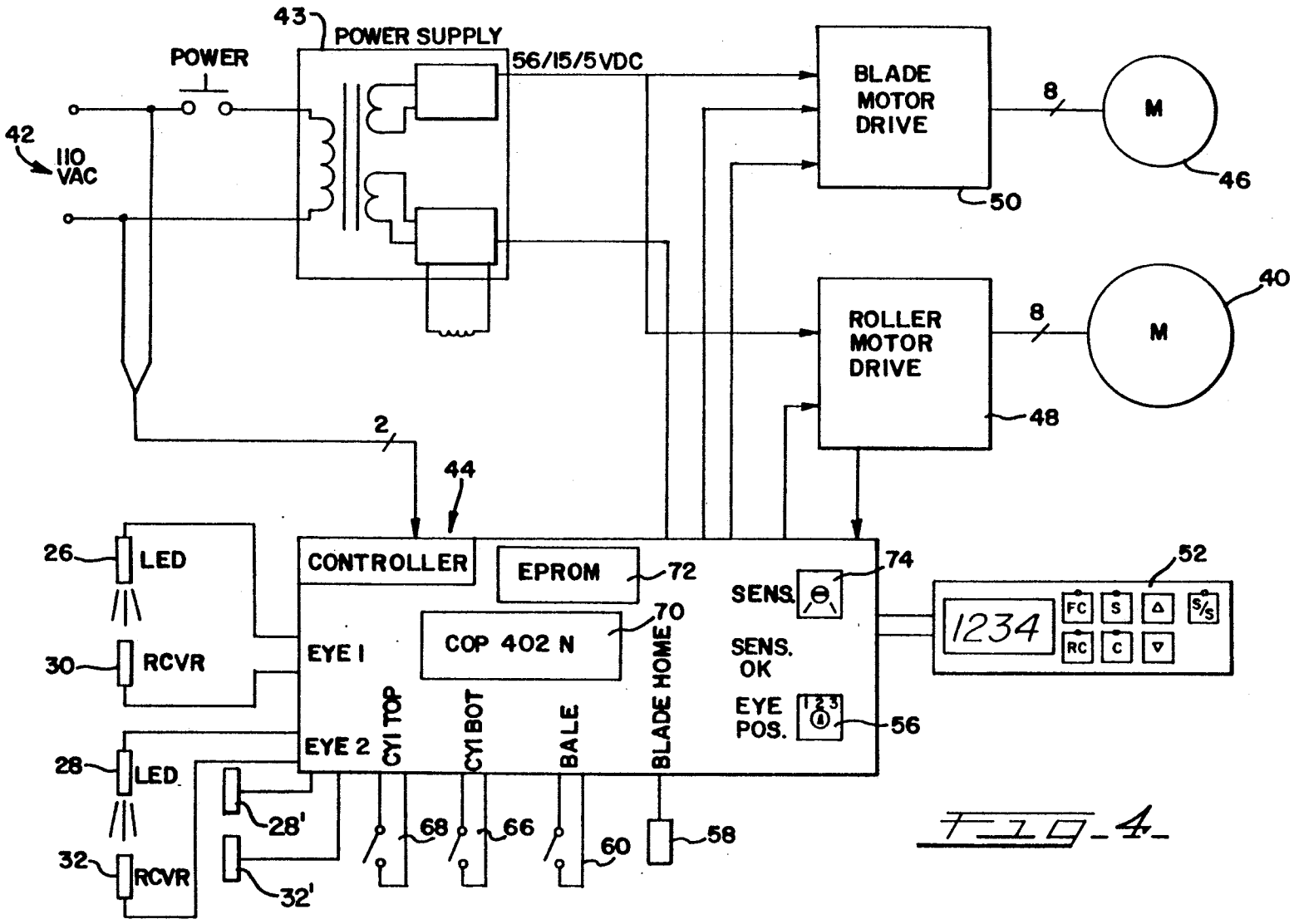
FIG. 4 is a system diagram of a preferred embodiment of the invention, and particularly showing the electronic feedback means and a portion of the blade positioning means.

The electronic feedback means is responsive to the sensors 20 and a pulse source forming part of step motor drive means 48 shown in FIG. 4. The electronic feedback means determine the extent of rotation of the cutting blade 14 necessary so that the blade is oriented parallel to the leading edge 38 of the sheet 16*a* prior to cutting the laminate material.

The electronic feedback means are shown in FIG. 4 of the drawings. A 110-volt, alternating current unswitched power source 42 is provided to power a controller 44. A transformer 43 provides stepped-down, direct-current power for step motor 40 and a second, smaller step motor 46. This smaller step motor 46, which will be fully described later, effects movement of the cutting blade 14. Motor 46 is also manufactured by Bodine, as model no. 2431.

As is known in the art, step motors require certain voltages and switching schemes in order to create the appropriate stepping. For this purpose, roller step motor 40 and blade step motor 46 are provided with roller motor drive means 48 and a blade motor drive means 50, respectively. Roller motor drive 48 also provides gearing effecting a 2:1 reduction, which effectively renders motor 40 a 400 step per revolution motor.

The roller motor drive 48 and the blade motor drive 50 are driven by "step" signal pulses. The direction of rotation of the blade motor drive 40 may be controlled by a "direction" signal. The "step" signal pulses from the controller 44 signals each motor to move a designated number of steps. The "direction" signal from the controller signals the movement of the blade motor, and ultimately the blade, in the desired clockwise or counterclockwise direction.

A display/keyboard 52 provides a means for user interface. It enables the user to turn the apparatus on and off, adjust its speed, control the length of the articles being cut, and establish the size of the laminate border, if any, surrounding the article.

The interruption and reception of light from infrared light beam sources (LED) 26 and 28 and their respective sensors (RCVR.) 30 and 32 is detected and determined by the controller 44. The sensors may be phototransistors. As indicated above, these sensors 30 and 32: (1) detect the interruption of light from the infrared light beams 26 and 28 when a sheet (16*a*, 16*b*, or 16*c*) is disposed between the sensors and the light beams; (2) detect light from the infrared light beams 26 and 28 when transparent laminate border material 54 is disposed between the detectors and the light beams.

Typically, the apparatus 12 is used with articles, such as sheets, of various widths. The apparatus can best ensure accurate cutting by placing the light beams and their associated detectors as far away from each other as possible. For example, with a 8½" wide sheet, the light beams and sensors are best placed about 7" apart. With a 14" wide sheet, however, the light beams and detectors are best placed about 12"–13" apart.

Accordingly, in an alternate embodiment of the invention, at least a pair of the light beam sources and associated light source are laterally movable. In this way, sheets of these and other varied widths can best be accommodated. For example, infrared light beam source 28 and its corresponding light sensor or "eye" 32 may be movable into any one of three positions. The controller 44 may include a manually-operable "eye" position switch 56 for moving beam 28 and "eye" 32 to any one of these positions.

In yet another variation of the embodiment of FIGS. 1–4, the apparatus 12 would include several more than two pairs of light sources and their corresponding sensor "eyes" to be selected in accordance with web width. FIG. 4 shows a third pair 28' and 32' thereof spaced from pair 26 and 30 a different distance than is pair 28 and 32. The controller 44 would determine the appropriate pair of beam source eye sets for a given article width from adjustment of eye position control 56 or automatically from the signals sent to controller. Thus, if the light to all three sensors 30, 32 and 32' are interrupted by a sheet, that indicates a wider sheet than if the light to only two sensors is interrupted. Particularly, the controller 44 would select the two most widely separated light source-sensor pairs for the widest sheets and the two closest interrupted light source-sensor pairs for the narrower sheet. As may be seen in both FIGS. 1 and 4, a blade home sensor 58 is provided. The blade home sensor 58 is adjacent the cutting blade 14 and determines its position. Particularly, the blade home sensor 58 in combination with the controller 44 determine the angular position of the blade at any given time. The blade position sensor 58 indicates when the blade is perfectly transverse to the web longitudinal axis (its zero position) and a blade position up-down counter in the controller has a plus or minus count in proportion to the clockwise or counterclockwise position of the blade relative to its zero position.

Referring now to FIG. 4, the controller includes a bale switch 60. This switch 60 is coupled to a bale arm (not shown). The bale arm and switch stop the roller drive motor if a web pair causes excessive tension in the laminate body 18.

During the cutting cycle, i.e., when the blade 14 is being raised or lowered, the web 18 is not being moved. Accordingly, drive rollers 20 and 22 are stationary during the cutting cycle. As may be seen in FIG. 1, a pair of air-actuated cylinders 62 and 64 are provided for lowering and raising the blade 14 at the appropriate intervals.

A cylinder bottom switch 66 and a cylinder top switch 68 are provided to indicate to the controller 44 the positions of the cylinders. The cylinder bottom switch 66 provides a signal to the controller 44 the instant a cylinder 62 or 64 has reached the bottom of its travel. This instant corresponds to the blade 14 reaching its lowermost position. The switches may be located at any desirable position, such as on the cylinder.

Immediately upon receipt of this signal from the cylinder bottom switch 66, the controller 44 powers air cylinders 62 and 64 to move the blade upward into its normal, uppermost position. Upon attaining this uppermost position, cylinder top switch 68 sends its own signal to controller 44. Upon receipt of this signal, the controller 44 restarts the drive rollers 20 and 22.

The output signals of a microprocessor 70 (no. COP 402N, manufactured by National Semiconductor) control the motors and other components of the apparatus 12. The microprocessor 70 itself is controlled by a software program entered into an EPROM 72, or electronically programmable read-only memory. The software program which is entered into this EPROM is attached as an integral part of this specification, appearing immediately before the claims.

The controller 44 also includes a sensitivity switch 74. This switch 74 is adjustable, and regulates the amount of light that must be sensed by sensors 30 and 32 corresponding to the "light received" condition. This switch 74 accounts for sheets 16 that may be very thin and of relatively low opacity. It also accounts for varying thicknesses and transparencies of the transparent laminate webs 18*a* and 18*b*.

Finally, blade positioning means are provided as the third component of the present apparatus. The blade positioning means are communicative with the electronic feedback means. Blade positioning means rotate the cutting blade 14 to a position where that blade is parallel to the leading edge of the article.

Figure 3:
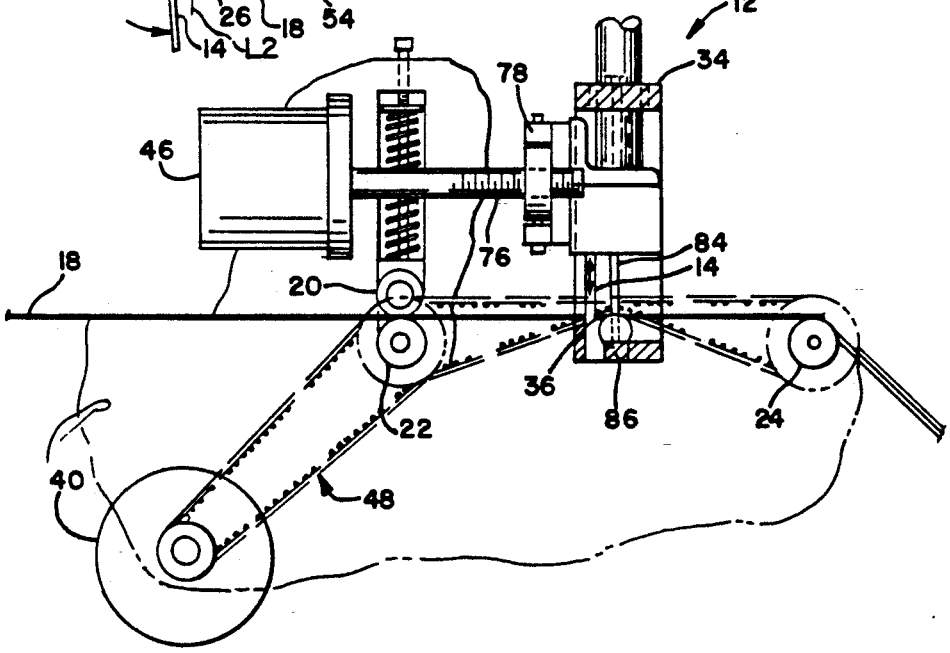
FIG. 3 is a side perspective view of the apparatus of FIG. 1, and showing the step motor for the cutting blade.

The blade positioning means can best be viewed in FIG. 3. Included are blade motor 46 and blade motor drive means 50. As indicated above, blade motor 46 and its associated motor drive means 50 provide 200 discrete steps per motor revolution. The output shaft of motor 46 is a ball screw 76 or threaded drive shaft connected at its end to a rotatable portion 78 connected to an arm 79 connected to an end of blade 14. The blade 14 pivots about a pivot point between its ends comprising, at the top, a brass bushing 80 held in place with a set screw 82 (FIG. 1). At the bottom, the pivot point is defined by a shaft and thrust bearing assembly. Particularly, a ⅝" shaft 84 is reduced at its end to ⅜" in diameter, and this reduced end is rotatable in an Andrews W-⅜" ball and roller bearing 86.

In the present embodiment, as indicated above, one step of the motor 40 moves both rollers 20 and 22 and article 16*a* forward 0.010". It will be obvious to the skilled artisan that these figures will vary according to the diameter of the rollers used. It will also be obvious to the skilled artisan that the time difference for offset article 16*a* to break light beam 26 and light beam 28 will depend on the spacing of the light beams from each other.

It will also be understood to the skilled artisan that this apparatus 12 can be used for cutting the article 16*a* at either its leading edge 38 or its trailing edge 88.

The apparatus 12 does not assume that the leading 38 and trailing edges 88 are offset the same number of degrees. Accordingly, the apparatus 12 will calculate, in the manner described above, two numbers that are stored in the memory of the microprocessor. The first is the offset angle of the leading sheet edge 38, and the second is the offset angle of the trailing edge 88. The computed angle is strictly a function of the number of steps that the motor moves forward between the time the first and second light beams are interrupted, and the distance between the two light beams.

These two angles can be translated into the required motion of the blade 14. In essence, the blade 14 must be turned by blade motor 46 enough to "cancel" the angle of edges 38 or 88 to the blade !4. The extent and direction of rotation of the threaded blade motor drive shaft 76 is determined by the pitch of its threads, the current angle of the blade 14, as read by blade home sensor 58, and the offset of the leading 38 or trailing edges 88 with the blade 14. The controller generates a direction signal in response to which light beam associated with sensors 30, 32 or 32' is first interrupted or re-established as a leading or trailing edge of a sheet reaches or passes by a light beam source-sensor pair.

The apparatus 12 in accordance with this embodiment can easily handle the cuts on the leading and trailing edges of forty articles or more per minute. Thus, eighty adjustments of the angle of cutting blade 14 per minute can be easily handled.

The third pair of sensing means 28' and 32' positioned along the same line L2 along which the other pair of sensing means 26 and 30 and 28 and 32 are located, which line is at right angles to the direction of movement of the laminate body 18 thereby. Controller 44 is designed to be responsive to the outer most pairs of sensing means when the light beams from all three light sources 26, 28 and 28' are interrupted by the passage of the leading edge of one of the sheets of the laminate body 18. Since the time difference between the times the leading edge will intercept the light beam for more widely spaced sensing means would be greater when the same leading edge intercepts the light beams from two more closely spaced sensing means the controller must operate with a different algorithm to determine the number of steps the blade 14 must be turned to effect the desired parallelism. The controller thus responds differently to the situation where all three light beams are interrupted than when only two of them are so interrupted. To simplify the algorithms, it is desireable that three pairs of sensing means are utilized to space each pair of sensing means from the adjacent one by the same distance along the second line L2.

Attached hereto ahead of the claims is the software program necessary for incorporation with the EPROM 72 shown in FIG. 4.

FIGS. 5-23 Analog Sensing Embodiment of the Invention

FIGS. 5 and 6—Cutter Apparatus Structure

The mechanical portions of the cutter mechanism apparatus shown in FIG. 5 is substantially the same as that shown in FIG. 1, except there is shown in FIG. 5 the keyboard 52 and the control box 52' of which the keyboard 52 forms a part, the bale switch arm 61 which stops operation of the apparatus when the tension on the laminate web body 18 indicates a jam in the system so as to cause the feeding of the laminate web body 18 to terminate, and a slotted plate 80 having slots SL1 and SL2 interposed respectively between light sources 26' and 28' and light sensors PC1 and PC2. Also, the size of the light sources and light sensors are such as to provide an even light intensity through the slots SL1 and SL2, so that there is a near linear variation of the sensor outputs as the leading and trailing edges of an opaque sheet steps along the slots.

FIG. 6 shows in greater detail a light source 26', light sensor PC1 and part of the slotted plate 80 which has a slot SL1 having an elongated shape whose longitudinal axis is parallel to the direction of movement of the laminate web body 18 through the cutter apparatus.

FIGS. 8 to 11—Leading Edge Angle Measurement and Web Advancement

Referring now more particularly to FIG. 8, this figure shows the angled leading edge 38 of an opaque sheet **16*a* located at the mid-point or "snapshot" point of the right slot SL2 and at the beginning of the left slot SL1 just prior to the measurement of the angle of the leading edge, which is followed by the rotation of the blade 14** to be parallel to the edge, the advancement of the edge to the blade and the "front cut" severance of the leading edge. The right light sensor PC2 will thus produce an output which is approximately ½ that of its maximum output if its minimum output is ideally zero. This occurs if the opaque sheet is ideally opaque so it blocks all light from sensor SL2 when the slot is completely covered thereby.

The preferred form of the invention repeatedly scans the sensor outputs when the slots are fully covered and uncovered, to correct the measurement of one of the light sensor outputs taken and the opaque sheet is in its "snapshot" position when the other light sensor output is at an exemplary reference mid-point measurement of 120. The measurement correction is referred to as a normalization procedure made by comparing the ideal maximum and zero outputs with those scanned, and making the needed measurement corrections by an equation to be given later on in the specification. These scanned output values can vary from the ideal calibrated maximum value or zero value because, among various reasons, of line voltage fluctuations, and light source or light sensor variables like aging, or when the sheets involved are not perfectly opaque.

With the particular angular position of the solid line leading edge 38 shown in FIG. 8, the output of the left sensor PC1 is at or near its maximum output because the opaque sheet interrupts practically no light passing through the left slot SL1. In the example of the invention being described, the ideal value of this maximum output is assumed to be a digital value of 242 when the apparatus is initially calibrated by an operator adjustment to be described. The leading edge 38 of the opaque sheet **16*a* is shown tilted at a given counterclockwise angle with respect to a line L2 which extends at right angles to the direction of movement of the laminate web body 18** and passes through the mid points of the slots SL1 and SL2.

A dashed line 38' illustrates the leading edge of a sheet like sheet **16*a* which is tilted to a lesser counterclockwise angle. It reaches the beginning of the left slot SL1 sooner than the leading edge 38 of the sheet 16*a* shown in solid lines, and thus the sheet having the lesser angled leading edge 38' will cover more of the slot SL1 than sheet 38 when the leading edge 38'** reaches the "snapshot" mid-slot position of the right slot SL2.

The control portions of the cutter apparatus makes a measurement of the outputs of the light sensors PC1 and PC2 in the "snapshot" position of the leading edge of each sheet. The difference in these outputs when the output of sensor PC1 is "normalized" is an accurate measure of the angle of inclination of the leading edge of the opaque sheet. The sensor output which first decreases to the mid-value of 120 indicates whether the leading edge angle makes a clockwise or counterclockwise angle with respect to the reference line L2. The program of the control system detects which sensor decreases to 120 first during the operating mode when the leading edge is next to be cut (referred to as the front cut mode) and sets a flag in data storage indicating whether the leading edge is a clockwise or counterclockwise angle with respect to line L2. The control portion of the apparatus then pivots the cutter blade in the direction indicated by that flag.

FIG. 9 illustrates the progressively changing output of the light sensors PC1 and PC2 as the leading edges 38 and 38' respectively of the two different angled opaque sheets move along the slots SL1 and SL2. Thus, the solid line curves PC2-a and PC1-a respectively show that the output of the light sensor PC2 progressively decreases from a maximum value of 242 before the curve PC1-a representing the output of light sensor PC1 begins to decrease from its maximum value. As just explained, when the output of the right light sensor PC2 reaches the mid point measurement of 120, the control apparatus of the invention measures the normalized difference of the outputs of the light sensors PC1 and PC2 at that instant of time and store that value for a computation which will determine the amount of pivot rotation to be imparted to the blade 14.

The dashed curve PC1-a' in FIG. 9 represents the variation in the output of the light sensor PC1 when the lesser angled leading edge 38' is moved along the slots SL1 and SL2. The output of the left light sensor PC1 when such a leading edge passes along the slot SL1 will start decreasing from 242 at a point in time closer to the point in time at which the output of light sensor PC2 starts decreasing from 242, and thus the difference in the outputs of the light sensors PC1 and PC2 at the snapshot time will be of a lesser magnitude. FIG. 9 shows a vertical line d1 representing the lesser difference in the outputs of the light sensors PC1 and PC2 at the snapshot time produced by the more steeply angled leading edge 38, and shows a shorter vertical line d2 representing the difference in these outputs at the "snapshot" time produced by the lesser angled leading edge 38'. The measurement of the light sensor SL1 at this snapshot time is stored for use in computations using an equation where the stored value is identified by the expression eye 1 mid. In this equation, the expressions eye 2 max and eye 1 max, eye 2 min and eye 1 min respectively represent the maximum and minimum sensor outputs scanned in the scanning cycle immediately prior to each "snapshot" position measurement. The scanning of these sensor outputs may be made just after the trailing edge of the preceding opaque sheet passes both slots and just after the leading edge of the opaque sheet involved passes both slots.

Under control of the program, a computation is carried out from the stored data indicating the theoretical direction and degree of rotation of the cutter blade 14 to bring it parallel to the leading or trailing edge involved and the result of this computations is compared with the then current position of the cutter blade indicated by a number stored in a blade position storage register. The number of motor step pulses needed to rotate the cutter blade into a position parallel to the sheet edge involved is then fed to the blade step motor.

The amount of forward movement which must be imparted to the laminate web body 18 after the snapshot measurement referred to is also computed to bring the center point of the sheet edge involved to or near the cutting blade, depending upon the angularity of the edge of the opaque sheet involved and whether a trimming is desired at a point spaced from the edge.

Figure 9A:
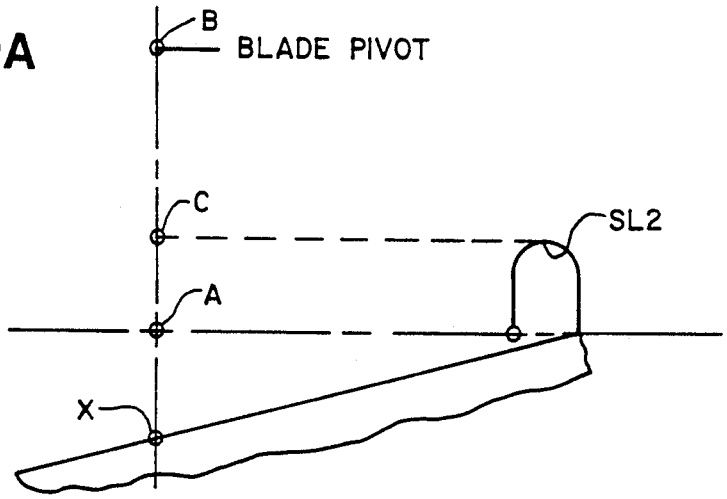
FIG. 9A is a diagram showing, among other things, how the distance between the center points of leading edges of differently angled sheets and the center point of a pivoted blade vary with the angle of the edges.

Refer now to FIG. 9A which shows the two differently angled position of the edges 38 and 38' of an opaque sheet in the "snapshot" position. The position of the center point of the more steeply angled edge 38 of the opaque sheet **16*a* is identified by the letter "X"; the position of the center point of the lesser angled sheet edge 38' is identified by the letter X', and the position of the pivot point of the blade 14 is identified by the letter "B". When the leading edge 38 has the steeped angle indicated and no trim is desired, the center point "X" of the leading edge 38 must be moved to point "B" and then stopped. The center point of the lesser angled edge 38' must be moved a lesser distance to the blade pivot point B. Accordingly, the program of the apparatus performs a computation to be described which computes the number of step pulses to be fed to the roller step motor 40** to effect this result, based on a number of factors including the measurement of the sheet edge angle when the sheet involved is in its "snapshot" position.

FIGS. 10 and 11 correspond to FIGS. 8 and 9 under the circumstances when the leading edges 38 and 38' of an opaque sheet **16*a* are respectively at greater and lesser angles in a clockwise rather than a counterclockwise direction from the reference line L2 interconnecting the center points of the slots SL1 and SL2. FIG. 11 shows by curve PC1-b that the output of the left sensor PC1 decreases from a maximum level 242 before the output from the right sensor PC2 indicated by curve PC2-b does so. The PC1-b output of the left sensor decreases to 120 first, to indicate that the cutting blade 14 must theoretically be pivoted in a clockwise direction to bring it parallel to the edge 38 or 38', (i.e. if the blade is in a squared or zero angle position). The program of the cutter apparatus effects computation of the difference between these outputs at the snapshot time. This measurement is indicated by the length of the line d1' for the steeper angled leading edge 38 and by the length of the line d2' for the lesser angled leading edge 38'**.

FIGS. 12 to 15—Trailing Edge Angle Measurement

Figure 12:
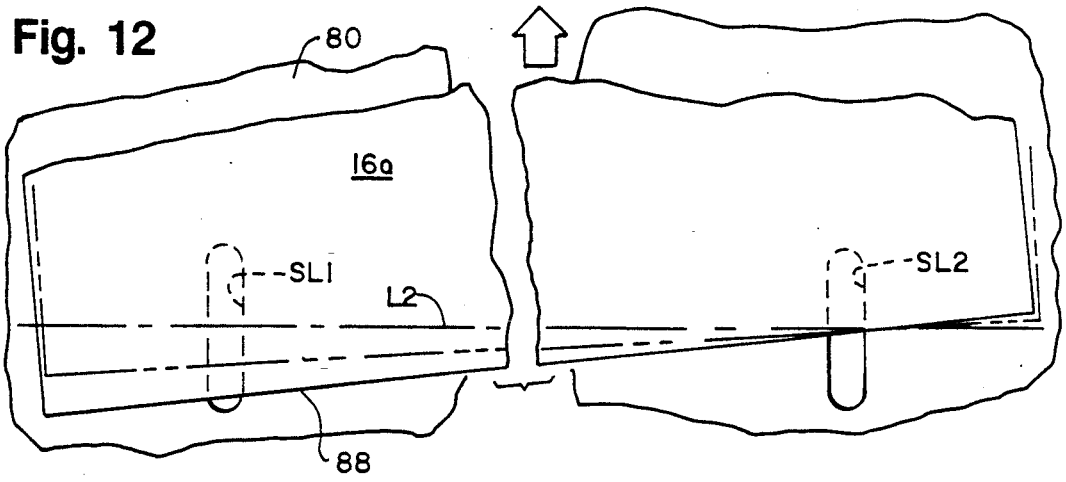
FIG. 12 is a view corresponding to FIG. 8 when the trailing edge of an opaque sheet having the respectively differently angled solid and dashed line trailing edge orientations shown reach said "snapshot" position partially intercepting light to the pair of slots shown in FIG. 5.
Figure 13:
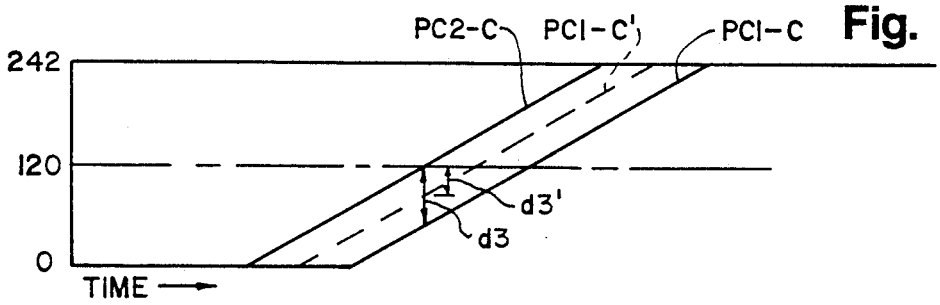
FIG. 13 shows two solid line curves representing the analog outputs of the two light sensors sensing the passage of light through the two slots shown in FIG. 12, as the angled trailing edge portion of the opaque sheet shown as a solid line therein progressively steps along the length of the slots, and a curve shown as a dashed line representing the progressively changing output of the light sensor associated with the left slot in FIG. 12 for an opaque sheet having the lesser angled trailing edge orientation shown as a dashed line in FIG. 12.

FIG. 12 shows the relationship of the greater and lesser counterclockwise angled trailing edges 88 and 88' of the opaque sheet **16*a* when each edge first reaches the center point of the right slot SL2 at the snapshot time when the sensor output measurement of the left sensor BL1 is taken. Then blade rotation, trailing edge advancement to the cutter blade and a "rear cut" severance of the trailing edge takes place. The slot SL2 is the first slot which becomes progressively uncovered by the greater angled sheet edge 88, causing a gradual increase in the output of the light sensor PC2 from a zero output, as illustrated by the curve PC2-c in FIG. 13. The output of the right sensor PC2 reaches the snapshot level of 120** before the output curve PC1-c representing the output of the left sensor PC1 does so.

As the lesser angled trailing edge 88' progressively uncovers the left slot SL1, it produces the varying output in left sensor PC-1 indicated by curve PC1-c'. The line d3 between the curves PC2-c and PC1-c indicates the difference in the right and left sensor outputs at the snapshot time caused by the greater angles trailing edge 88. The line d3' between the curves PC1-c and PC2-c' indicates the difference in this measure at the snapshot time caused by the lesser angled trailing edge 88'. The program of the cutter apparatus of the invention, when the output of the sensor PC2 first reaches the level of 120, effects the counterclockwise rotation of the cutter blade to bring the cutter blade parallel to the trailing edge involved if the blade 14 is in a squared or zero angle position.

Figure 14:
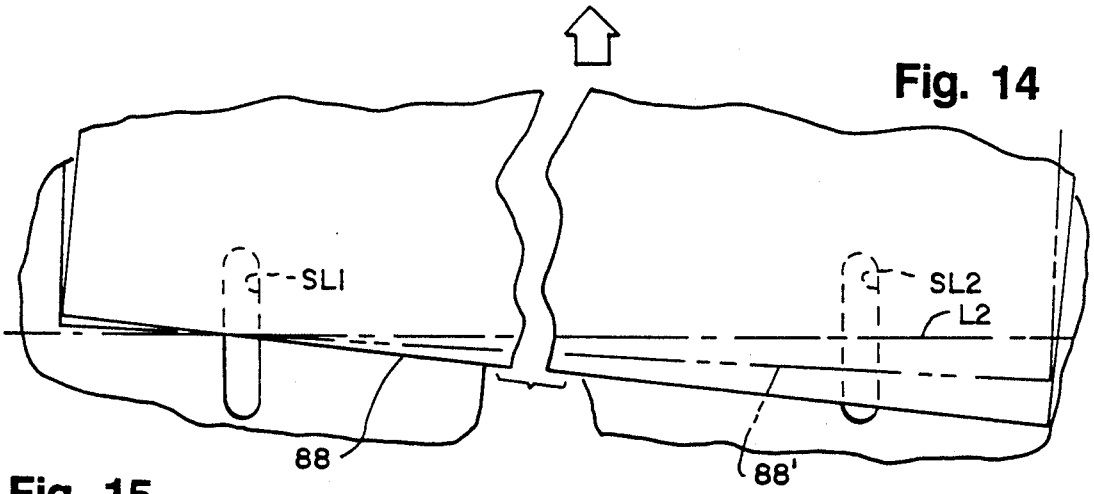
FIG. 14 is a view corresponding to FIG. 12 when the trailing edge portion of an opaque sheet having the solid and dashed line orientation shown therein which angle in the opposite direction from that shown in FIG. 12 are partially intercepting the pair of slots shown therein when the sheet is said "snapshot" position.
Figure 15:
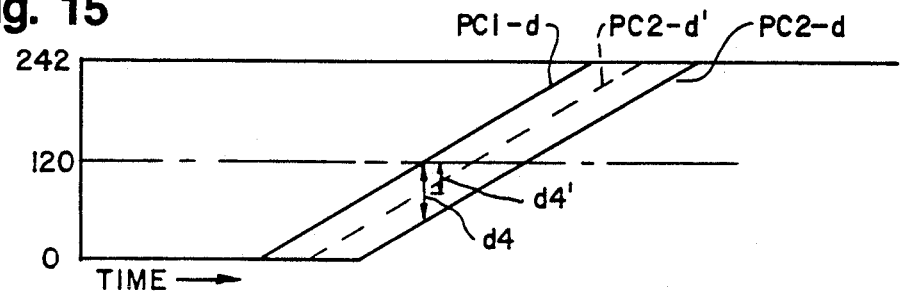
FIG. 15 shows two solid line curves representing the analog outputs of the two light sensors sensing the passage of light through the two slots shown in FIG. 14, as the angled trailing edge portion of the opaque sheet shown as a solid lines in FIG. 14 progressively steps along the length of the slots, and a curve shown as a dashed line representing the progressively changing output of the light sensor associated with the right slot in FIG. 14 for an opaque sheet having the lesser angled trailing edge orientation shown as a dashed line in FIG. 14.

FIGS. 14 and 15 respectively show the relationship of the greater and lesser clockwise angled trailing edges 88 and 88' of an opaque sheet to the slots SL1 and SL2 at the snapshot time, and the progressive variation of the outputs of the associated sensors PC1 and PC2 as the trailing edges progressively uncover the left and right slots SL1 and SL2. In this case, the output of the left sensor PC1 will reach the 120 level first to indicate to the program of the apparatus that the cutter blade 14 must be theoretically rotated in a clockwise direction to bring it parallel to the trailing edges 88 and 88'.

Figure 16:
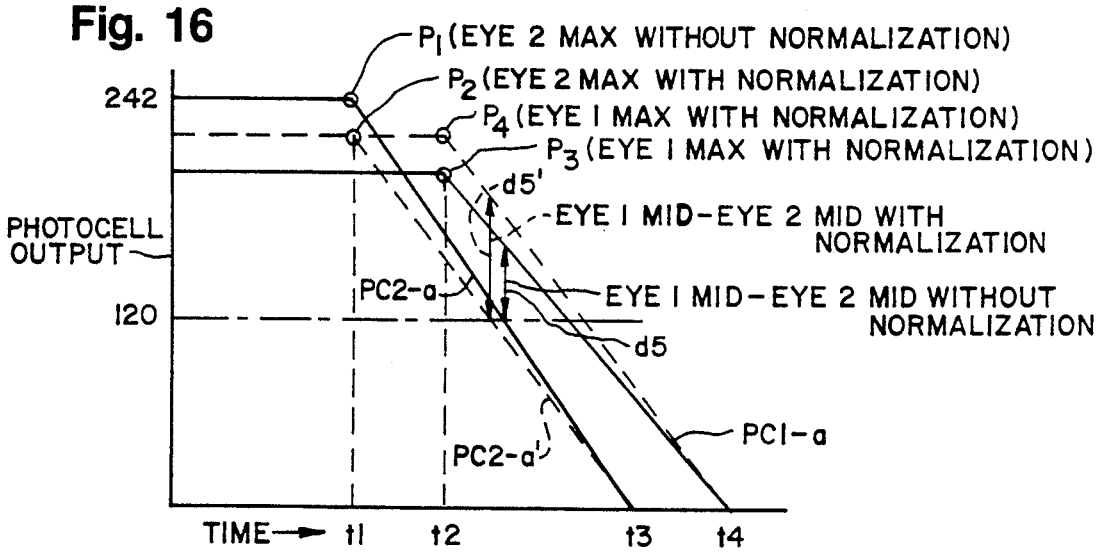
FIG. 16 shows two curves in solid lines representing the analog outputs of the two light sensors where the maximum intensity outputs thereof respectively decrease from undesired different maximum reference levels, as the angled leading edge portion of an opaque sheet progressively steps along the length of the slots shown in FIG. 5, and two dashed line curves which represent the sensor outputs decreasing from the same desired maximum reference level, the figure also showing the variation in the "snapshot" time difference measurements obtained therefrom, one such measurement being corrected by the normalization procedure carried out by the preferred form of the present invention.
Figure 17:
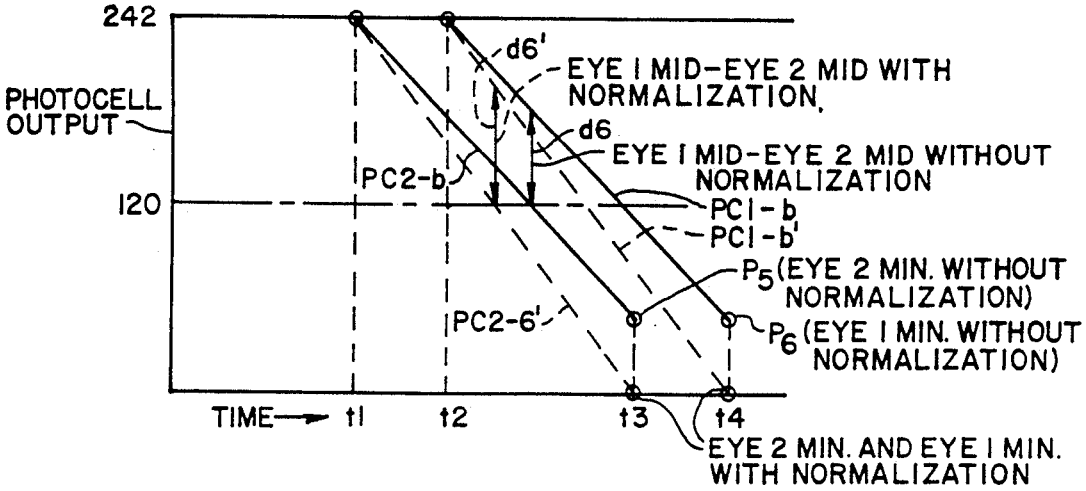
FIG. 17 shows two solid line curves representing the analog outputs of the light sensors as the angled leading edge portion of an opaque sheet progressively steps along the length of the associated slots, and wherein these outputs decrease from the same desired upper reference level to minimum values undesirably greater than zero because the sheet is not perfectly opaque, and shows two dashed line curves having desired zero minimum values, the figure also showing the variation in the "snapshot" time difference measurements obtained therefrom, one such measurement corrected by the normalization procedure carried out by the preferred form of the present invention.

FIGS. 16 and 17—Normalization of Mid-point Snapshot Measurements

Refer now to FIG. 16 which explains the circumstance under which the maximum output of the right light sensor PC2 decreases to zero along curve PC2-a from a maximum value identified at point P1, which is greater than the desired reference maximum of 242, and the left light sensor PC1 decreases to zero along a curve PC1-a from a maximum value identified at point P3 which is less than the desired maximum level of 242. The curves desirably should have decreased to zero from the same desired maximum value of 242 respectively along the dashed line PC2-a' and PC1-a'.

Without normalization, the snapshot value difference between the outputs of light sensors PC1 and PC2 is identified by the line d5, which provides an erroneous measurement for the angle of inclination of the leading edge involved. The desired difference in the outputs of the light sensors PC1 and PC2 at the snapshot time is identified by the line d5', which is much larger than the line d5. The difference in the lengths of these lines d5 and d5' indicates the error in the angular measurement because the maximum intensity outputs of the light sensors PC2 and PC1 decreased from levels other than the desired reference level 242. As previously indicated, by using proper equations and measurements of the actual maximum intensity values of the light sensors PC1 and PC2, a normalization or correction of the snapshot values can be obtained in the preferred form of the invention.

Refer now to FIG. 17 which explains the errors which can be introduced in the angle measurements of the leading edge of an opaque sheet when the minimum sensor output values caused by the opaque sheets being less than fully opaque create minimum values at the outputs of the light sensors PC1 and PC2 which are other than zero. Thus, the solid line PC2-b representing the variation in the output of the right light sensor PC2 decreases from the desired level of 242 to a level indicated by the point P5 which is greater than zero. Similarly, the solid line PC1-b showing a variation in the output of the left light sensor PC1 decreases from the desired maximum value of 242 to a level other than zero at point P6. The difference in the snapshot time values of the output of the light sensors PC1 and PC2 without corrections is indicated by the length of line d6.

The dashed lines PC2-b' and PC1-b' represents the variation in the output of the light sensors PC1 and PC2 as they decrease from 242 to ideal zero. The difference in the snapshot time values of the outputs of the light sensors under the actual conditions is identified by the length of line d6, and the ideal condition when they decrease to zero by the length of the line d6'. The difference in the lengths of the lines d6 and d6' is the error measurement which would occur if a normalization procedure was not carried out.

Figure 18:
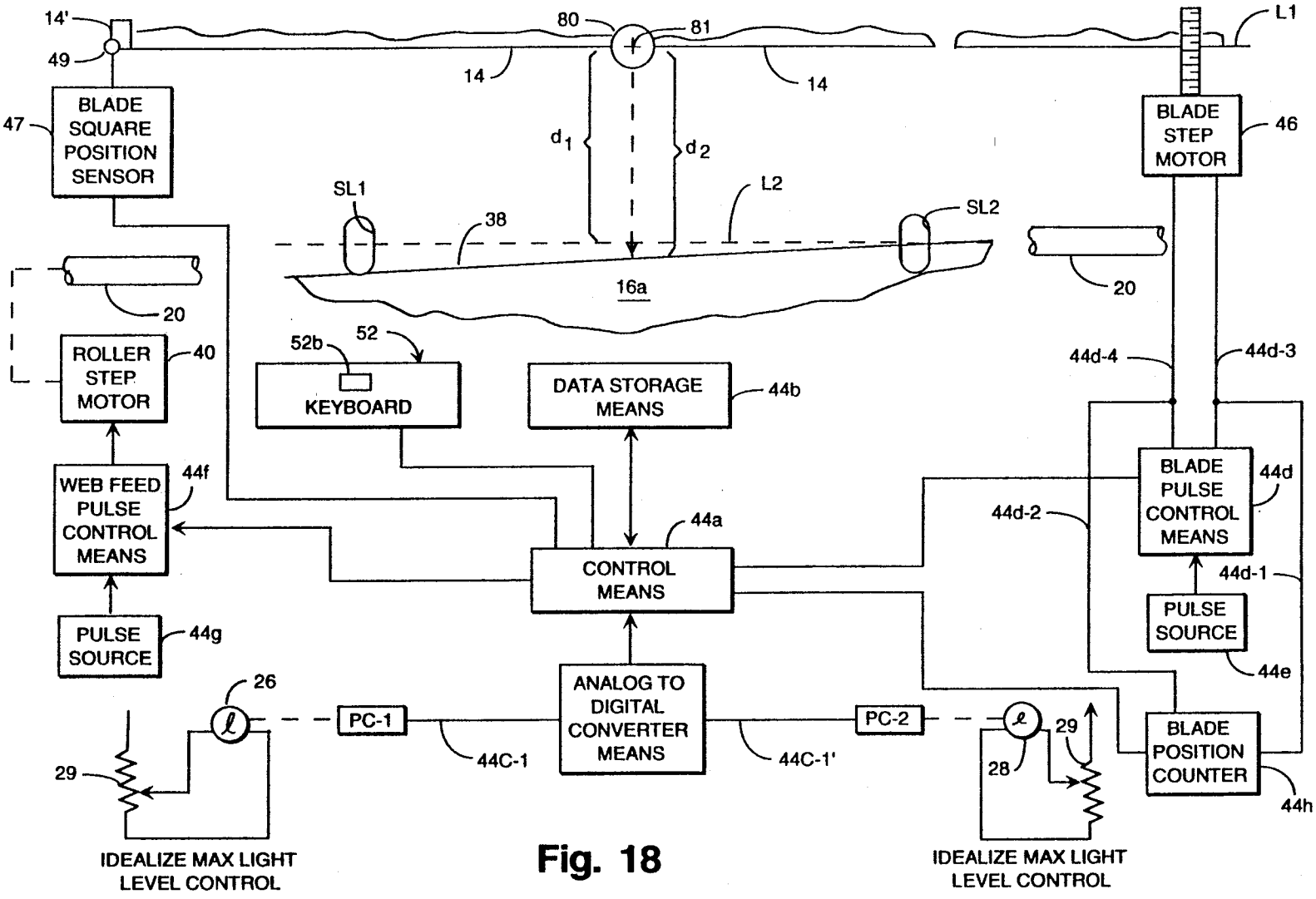
FIG. 18 is a detailed block diagram of the electrical microprocessor control system of the FIG. 5 embodiment of the invention.

FIG. 18—Control System Block Diagram

Refer now to the block diagram of FIG. 18 which shows the basic electrical control system of the cutter apparatus now being described. The angular position of the blade 14 at any instant is determined by a position number stored in a blade position counter 44*h*. This blade position counter is an up-down counter which has a median number greater than zero stored therein when the blade 14 is in a perfectly square position, meaning perfectly transverse to the direction of movement of the web body 18. That number progressively increases from this number as the blade is rotated progressively increases in one direction from this squared position and progressively decreases from this number toward zero as the blade is progressively rotated in the opposite direction. The blade 14 carries an opaque piece 14' which, when the blade is square, intercepts a light beam source directed to a sensor 49.

When the blade motor screw 76 rotates in a direction to pivot the blade 14 in a clockwise direction, the blade position counter 44*h* receives count pulses from a blade pulse position control means 44*d* to which a pulse source 44*e* continuously feeds pulses at a predetermined pulse rate. The pulse blade control means 44*d* acts as a gate circuit gating pulses from the pulse source 44*e* to the blade step motor 46 on a line 44*d*-3 and to the blade position counter or storage means 44*h* on a line 44*d*-1. These pulses advance or reduce the count in the counter 44*h* and rotate the blade 14 in a direction depending upon the direction signal fed from the pulse source control means 44*d* to the motor 46 on a line 44*d*-4 and to the counter 44*h* on a line 44*d*-2.

The blade pulse control means 44*d* is controlled from program control means 44*a* which, along with the other control means shown in FIG. 18, are part of a microprocessor controller operating in a manner similar in some respects to the controller 44 in FIG. 4 which operates the embodiment of the invention of FIGS. 1–4, but modified to perform the different angle measurement programs to be described.

The measurements which are taken by the cutter apparatus under control of the program, such as the measurements of the outputs of sensors PC1 and PC2, are fed respectively on lines 44*c*-1 and 44*c*-1' to an analog to digital converter means 44*c* which converts the analog measurements of the light sensors PC1 and PC2 to digital signals fed through the program control means 44*a* to a data storage means 44*b*.

During the setup of the apparatus, the operator adjusts a pair of potentiometers 27 and 29 which control the magnitude of the current through the light sources 26 and 28 so that the output of light sensors PC1 and PC2 respectively have an output level of 242. The measurements are indicated on a screen 52b forming part of the keyboard 52' to be described. As previously indicated, the outputs of sensors PC1 and PC2 are repeatedly scanned under the condition where the slots SL1 and SL2 are completely blocked and unblocked to establish actual minimum and maximum reference values (eye 1 max, eye 2 max, eye 1 min and eye 2 min) which are stored in data storage means 44h and used in the "normalization" procedure previously referred to. As previously indicated, this normalization procedure, modifies the snapshot measurement value to a value which would have been obtained if the actual maximum and minimum values of sensors PC1 and PC2 were 242 and 0, respectively.

A pulse source 44g is fed to the web feed pulse control means 44f which is a gate circuit similar to the blade pulse control means 44b, and is controlled by the program control means 44a. The program control means 44a carries out a computation to determine the desired distance between the center point of the leading or trailing edge of the opaque sheet involved at the snapshot time and the pivot point of the blade, which distance varies with the angle of the edge involved and trim and deceleration factors to be described, so that the feeding of the opaque sheet can stop at the desired point beneath the cutting edge of the blade 14. The output of the web feed pulse control means 44f is thus fed to the roller step motor 40 which drives the web feed rollers 20 a proper amount to effect this result.

The various computations which are carried out by the program control means 44a will now be described.

Equations Carried Out By Apparatus Program

The following Equation 1 for front cut mode computes a value referred to as "eye 1 normal", which is the normalized or corrected snapshot time measurement ("eye 1 mod") for the output of the left light sensor when the output of the right light sensor decreases to 120:

Equation 1 (for front cut mode):

$$\text{eye 1 normal} = \frac{(\text{eye 1 mid} - \text{eye 1 min}) \times 242}{\text{eye 1 max} - \text{eye 1 min}}$$

Similarly, the following Equation 2 for front cut mode computes a value referred to as "eye 2 normal", which is the normalized or corrected snapshot time measurement of the output ("eye 2 mid") of the right light sensor SL2 when the output of the left light sensor decreases to 120.

Equation 2 (for front cut mode):

$$\text{eye 2 normal} = \frac{\text{eye 2 mid} - \text{eye 2 min}) \times 242}{\text{eye 2 max} - \text{eye 2 min}}$$

The following Equation 3a for front cut mode is a factor in Equation 4 which Equation 3a identifies at snapshot time the location of the leading edge center relative to the center of line L2 between the slot centers, in terms of the number of step pulses which must be fed to the roller step motor 40 to move the center point of the leading edge to the line L2, when the leading edge makes a clockwise angle with respect to the line L2:

Equation 3a (for front cut mode):

-continued $$\text{Material Center} = \frac{\text{eye 2 normal} - \text{eye 1 normal}}{C1}$$

(Where C1 is a constant depending on the spacing between the center of slots SL1 and SL2. It is 24 when the center points of slots SL1 and SL2 are spaced 6" apart and each pulse applied to the roller step motor 40 will advance the web 0.01").

The following Equation 3b for front cut mode is a factor in Equation 4 which Equation 3b identifies at snapshot time the location of the leading edge center with respect to the line L2 in terms of the number of step pulses which must be fed to the roller step motor 40 to move the center point of the leading edge to the line L2, when the leading edge makes a counterclockwise angle with respect to the line L2:

Equation 3b (for front cut mode):

$$\text{Material Center} = \frac{\text{eye 1 normal} - \text{eye 2 normal}}{C1}$$

The following Equation 3c for front cut and rear cut mode is a constant identifying one-half the slot size in terms of roller motor step pulses needed to move the edge center, and is a factor in Equations 4 and 4':

Equation 3c (for front or rear cut modes):

Center to Edge=(Center of eye 1 or 2 to edge of eye 1 or 2) ×Steps per inch (This center to edge distance is given in terms of the number of pulses fed to the roller step motor 40 necessary to move the web one-half of a slot length.) This equals 10 where the spacing between the center point of the slots SL1 or SL2 and the edge of the slot nearest the cutting blade is 0.001".

Equation 4 for a front cut mode computes the number of pulses which must be fed to the roller step motor 40 to move the center point of the leading edge of the sheet in a snapshot position to or adjacent the pivot point of the blade which varies depending upon whether a trim cut is to be made. It is understood that, to avoid overrun due to inertial effects where necessary for accuracy, the step pulse rate is gradually reduced so that there will be no significant error-causing overrun at the receipt of the last pulse:

Equation 4 (for front cut mode):

Roller motor forward advance=material center+center to edge +front cut−(trim)

(where "front cut" is the distance of the slot edge closest to the cutting blade to the cutting blade in terms of step motor pulses; the "trim" factor is the amount in terms of step motor pulses one desires to cut beyond the leading edge).

The following Equation 5 computes for front cut mode the number of step pulses to be fed to the blade step motor when the blade in an ideal squared position to bring the cutting blade parallel to the leading edge involved, the step pulses causing the blade step motor to rotate the blade in one direction or the other depending upon the direction control signal fed to the blade step motor:

Equation 5 (for front cut mode):

Blade motor forward or backward rotation = C2 × (eye 2 normal, or eye 1 normal − eye 1 normal, or eye 2 normal)

(where C2 is a constant depending upon the distance between the point the blade motor screw 76 connects with the blade and the pivot point of the blade). The constant C2 has a value which varies with the distance between the center points of the slots and the incremental angle which the shaft of the step motor 46 moves in response to each step pulse received by the motor to vary the angle of the blade. For very small angles between the adjusted angle of the blade 14 and the squared position of the blade, it is assumed that the increments in angle variation vary in linear relationship to the number of pulses fed to the blade step motor 46.

The following Equation 1' for rear cut mode computes a value referred to as "eye 1 normal", which is the normalized or corrected snapshot time measurement ("eye 1 mid") for the output of the left light sensor when the output of the right light sensor increases to 120:

Equation 1' (for rear cut mode):

$$\text{eye 1 normal} = \frac{(\text{eye 1 mid} - \text{eye 1 min})242}{\text{eye 1 max} - \text{eye 1 min}}$$

Similarly, the following Equation 2' for rear cut mode computes a value referred to as "eye 2 normal", which is the normalized or corrected snapshot time measurement ("eye 2 mod") of the output of the right light sensor when the output of the left light sensor increases to 120.

Equation 2' (for rear cut mode):

$$\text{eye 2 normal} = \frac{(\text{eye 2 mid} - \text{eye 2 min})242}{\text{eye 2 max} - \text{eye 2 min}}$$

The following Equation 3a' for rear cut mode is a factor in Equation 4' which Equation 3a' identifies the location at snapshot time of the leading edge center relative to the center line L2 between the slot centers in terms of the number of step pulses which must be fed to the roller step motor 40 to move the center point of the trailing edge to the line L2, when the trailing edge is a counterclockwise angle with respect to the line L2:

Equation 3a' (for rear cut mode):

$$\text{Material Center} = \frac{\text{eye 2 normal} - \text{eye 1 normal}}{C1}$$

(where C1 is a constant depending on the spacing between the center of slots SL1 and SL2. It is 24 when the center points of slots SL1 and SL2 are spaced 6" apart and each pulse applied to the roller step motor 40 will advance the web 0.01").

The following Equation 3b' for rear cut mode is a factor in Equation 4' which Equation 3b' identifies at snapshot time the location of the trailing edge with respect to the line L2 in terms of the number of step pulses which must be fed to the roller step motor 40 to move the center point of the trailing edge to the line L2, when the leading edge makes a counterclockwise angle with respect to the line L2.

Equation 3b' (for rear cut mode):

$$\text{Material Center} = \frac{\text{eye 1 normal} - \text{eye 2 normal}}{C1}$$

Equation 4' for rear cut mode computes the number of pulses which must be fed to the roller step motor 40 to move the center point of the leading edge of the sheet in a snapshot position to or adjacent the pivot point of the blade, which varies depending upon whether or not a trim cut is to be made. It is understood that to avoid overrun due to inertial effects that, where necessary for accuracy, the step pulse rate is gradually reduced so that there will be no significant error-causing overrun at the receipt of the last pulse.

Equation 4' (for rear cut mode):

Roller motor forward advance = material center + center to edge + rear cut + trim (where "rear cut" is the distance of the slot edge closest to the cutting blade in terms of step motor pulses; the "trim" factor is the amount in terms of step motor pulses one desires to cut beyond the trailing edge.

The following Equation 5' for rear cut mode computes the number of step pulses to be fed to the blade step motor when the blade is in an ideal squared position to bring the cutting blade parallel to the leading edge involved, the step pulses causing the blade step motor to rotate the blade in one direction or the other depending upon the direction control signal fed to the blade step motoring:

Equation 5' (for rear cut mode):

Blade motor forward or backward rotation = C2 × (eye 2 normal, or eye 1 normal − eye 1 normal, or eye 2 normal)

(where C2 is a constant depending upon the distance between the point the blade motor screw 76 connects with the blade and the pivot point of the blade). The constant C2 has a value which varies with the distance between the center points of the slots and the incremental angle which the shaft of the step motor 46 moves in response to each step pulse received by the motor to vary the angle of the blade. For very small angles between the adjusted angle of the blade 14 and the squared position of the blade, it is assumed that the increments in angle variation vary in linear relationship to the number of pulses fed to the blade step motor 46.

FIGS. 7 and 7A—Indicating Panel Operation

The indicator and control panel 52 preferably has a main power on-off switch 52*a*. The panel 52 also has four depressible keys 52*c*, 52*d*, 52*e*, and 52*f*. Adjacent the key 52*c* is an upwardly pointing arrow 52*c'*; adjacent the key 52*a* is a downwardly pointing arrow 52*d'*; adjacent the key 52*e* appears the word "MODE"; adjacent the key 52*f* are the words "RUN" and "STOP"; and above the key 52*f* are red and green lamps 52*f* and 52*f'*. When the main power switch 52*a* is on, the operator still has control to operate the equipment in a "RUN" mode or a "STOP" mode. If depressing the key 52*f* lights the red light 52*f*, then the apparatus is effectively shut down. If when the key 52*f* is depressed, the green light 52*f'* is lit, that indicates that the equipment is in a running condition.

Below the screen 52b is a "COUNT" light 52g, a "SPEED" light 52h, a "FRONT CUT" light 52i and a "REAR CUT" light 52j. When the "MODE" switch is successively depressed, it will successively light the lights 52g, 52h, 52i, and 52j. When the "SPEED" light 52h is lit, there will appear on the screen 52b a number indicating the feeding rate of the web body 18. When the "FRONT CUT" light 52i is lit, there appears on the screen 52b a number which indicates the desired trimming distance that the cutting knife 14 will cut through the web body 18 at a given selected distance from the leading edge involved. When the "REAR CUT" light 52j is lit, a number appears on the indicating screen which indicates the amount of trim beyond the trailing edge of the sheets the cutting operation will produce. The "SPEED", "FRONT" and "REAR CUT" numbers appearing on the indicating screen 52b can be adjusted up and down by depressing the UP and DOWN keys 52c and 52d. These adjustments respectively affect the web feeding speed, and the "FRONT" and "REAR" trim distances.

If a "CUT" length setting is decreased below zero, the word "OFF" appears on the indicating screen 52b. The sheet counter resets to zero when power is applied, and will count up to a maximum count of 9,999. The counter may be reset at any time with the power "ON" by pressing both the "UP" and "DOWN" keys 52c and 52d simultaneously.

The "UP" and "DOWN" keys 52c and 52d will preset a sheet counter to the number of sheets desired to be severed from the web body 18. When started, the counter will count down while cutting until the counter zero on the indicating screen 52b, at which time the machine will turn itself off. Also, the equipment preferably has an automatic-OFF mode which the equipment halts itself to the sheet counter concept 9,999 or if no sheet edges are detected, after about one foot of travel of the web body 18.

The apparatus is preferably self-calibrating when power is turned "ON". To do this, the "CLEAR" part of the web body between the opaque sheets must be placed under the light source 26'. Thus, at power "ON", the indicating screen 52b shows "0", the operator knows that the sensors are properly calibrated to produce the desired maximum intensity of 242 and the apparatus is ready to be run. If the indicating screen 52b shows "EYES", that means that the sensors must be calibrated using the calibration mode, in part previously described, when the adjustment of the potentiometers 27 and 29 shown in FIG. 18 are made as described. To obtain the calibration mode when power is turned on, any key is pressed and the indicating screen shows two sets of horizontally elongated rectangles 53a-53b-53c and 53a'-53b'-53c'. The left potentiometer 27 is adjusted until the center rectangle of the left set of rectangles is fully lit, and the right potentiometer 29 is adjusted until the center rectangle 53b' of the right set of rectangles is fully lit. The machine is so designed that upon completion of the calibration of the sensors, if power is turned "OFF" and then back "ON", and a "0" display appears, that indicates the machine is ready to run.

Figure 19:
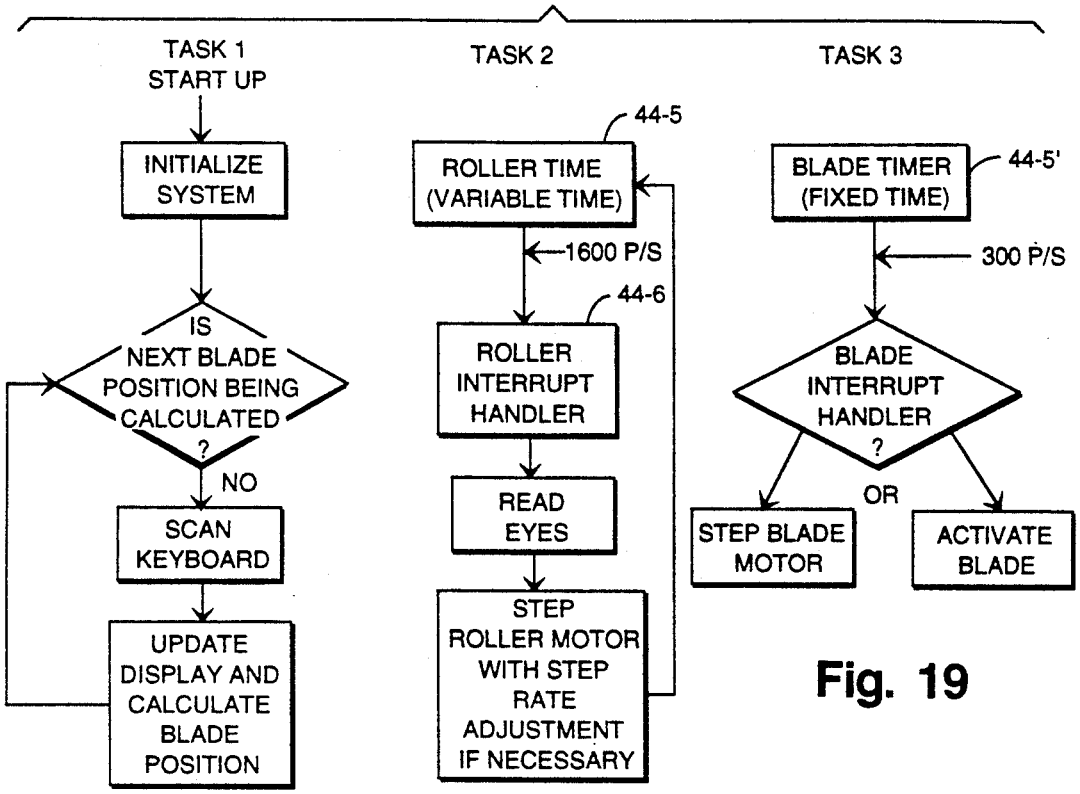
FIG. 19 shows the preferred architecture of the program forming part of the control system shown in FIG. 18.

FIG. 19—Program Architecture

The description of the block diagram of FIG. 19 (and of FIGS. 19-22 now to be briefly described) do not refer to all the blocks therein because the program functions performed thereby are apparent from the block indicia. The comments to be made herein therefore describe only some of the functions performed by some but not all of the program elements represented by the block.

FIG. 19 illustrates the preferred multitasking architecture of the software. All elements thereof will not be described herein since the blocks are generally self identifying. The comments to follow summarize some of the functions performed by these elements.

"Multitasking" refers to an architecture in which several separate tasks appears to be done simultaneously. These tasks are preferably done at the same time. In FIG. 19, task 1 is a loop which, after system initialization, the program scans the keyboard controls, updates the machine's display if required, and calculates the next required blade position angle, if blade movement is required.

Task 2 is triggered by a variable timer which, when required, calls the "roller interrupt handler" 44-6 which will read the machine's "eyes" PC1 and PC2 and/or step the machine's rollers 20. Task 3 is triggered by the "blade timer" 44-5' which initiates either stepping of the blade motor 46 which adjusts the blade angle or activates the blade's up/down cutting stroke sequence.

The key point in FIG. 19 is that this architecture results in these three tasks apparently occurring simultaneously; that is, motion of the web via the roller motor 40 and the blade via the blade motor 46 can occur simultaneously. The advantage of this is that both the rollers 20 and the blade 14 can be actively in motion at the same time, reducing positioning time and increasing thruput.

Figure 20:
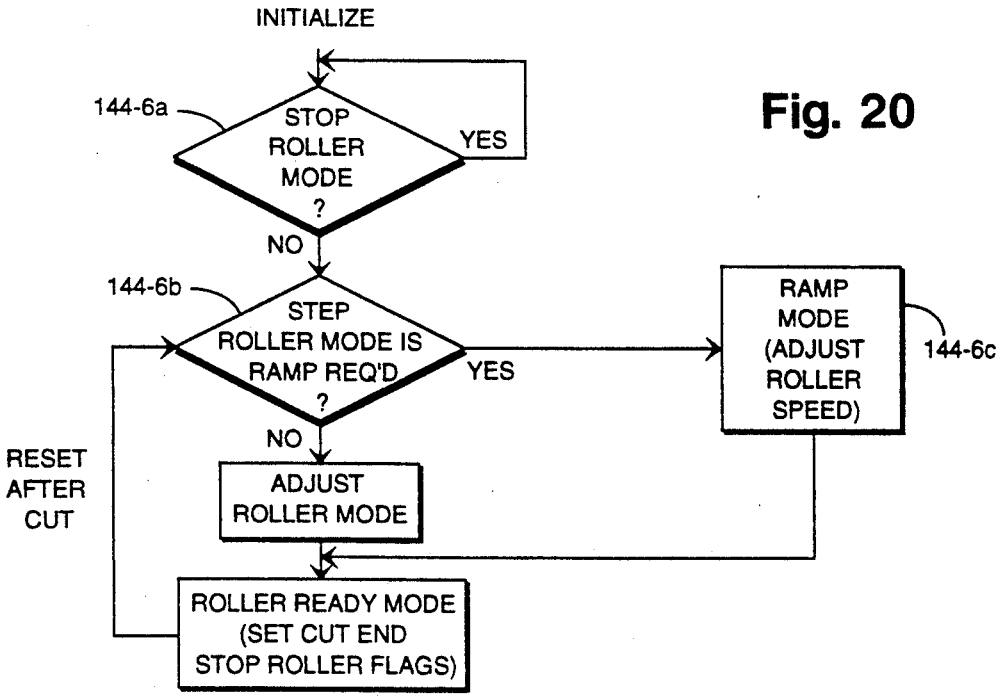
FIG. 20 illustrates in detail the roller interrupt handler portion of the program indicated as a single block in FIG. 19.

FIG. 20—Roller Interrupt Handler 44-6

In the multitasking architecture, the roller interrupt handler 44-6 is called whenever the internal roller timer 44-5 (FIG. 19) generates an interrupt. This timer is variable because the roller speed is controllable via the keyboard 52', and also up/down ramping for high speed operation is controlled here. Where ramping is necessary, the pulse rate must be gradually ramped up and down to or from the maximum rate.

The roller interrupt handler can be thought of as the part of the program which handles all positioning requirements of the machine's rollers 20. When the roller timer 44-5 generates an interrupt, calling the roller interrupt handler 44-6, the system checks first to see if the roller is in the "STOP" mode in program step 144-6a; this is the case if a "CUT" is in progress. If no "CUT" is in progress, the blade 14 is disabled from cutting (stop blade mode). If the material to be cut is not yet in final position, the program decides to step the roller motor 40 (step roller mode in program step 144-6b). At this time the program checks to see if ramping is required by comparing the selected rate of the rollers 20 to the maximum rate allowable without ramping. In the ramp mode carried out by a program step 144-6c, the roller timer (FIG. 19) is software controlled to ramp up and down at a predetermined rate to avoid abrupt starts and stops, which would cause accuracy losses. The roller interrupt handler will continue to step the material forward until the web is in the desired position for a cut, indicated by the roller interrupt handler setting a flag to indicate the roller ready mode; that is, a flag which indicates the material is in its final position and a cut may now be made.

Figure 21:
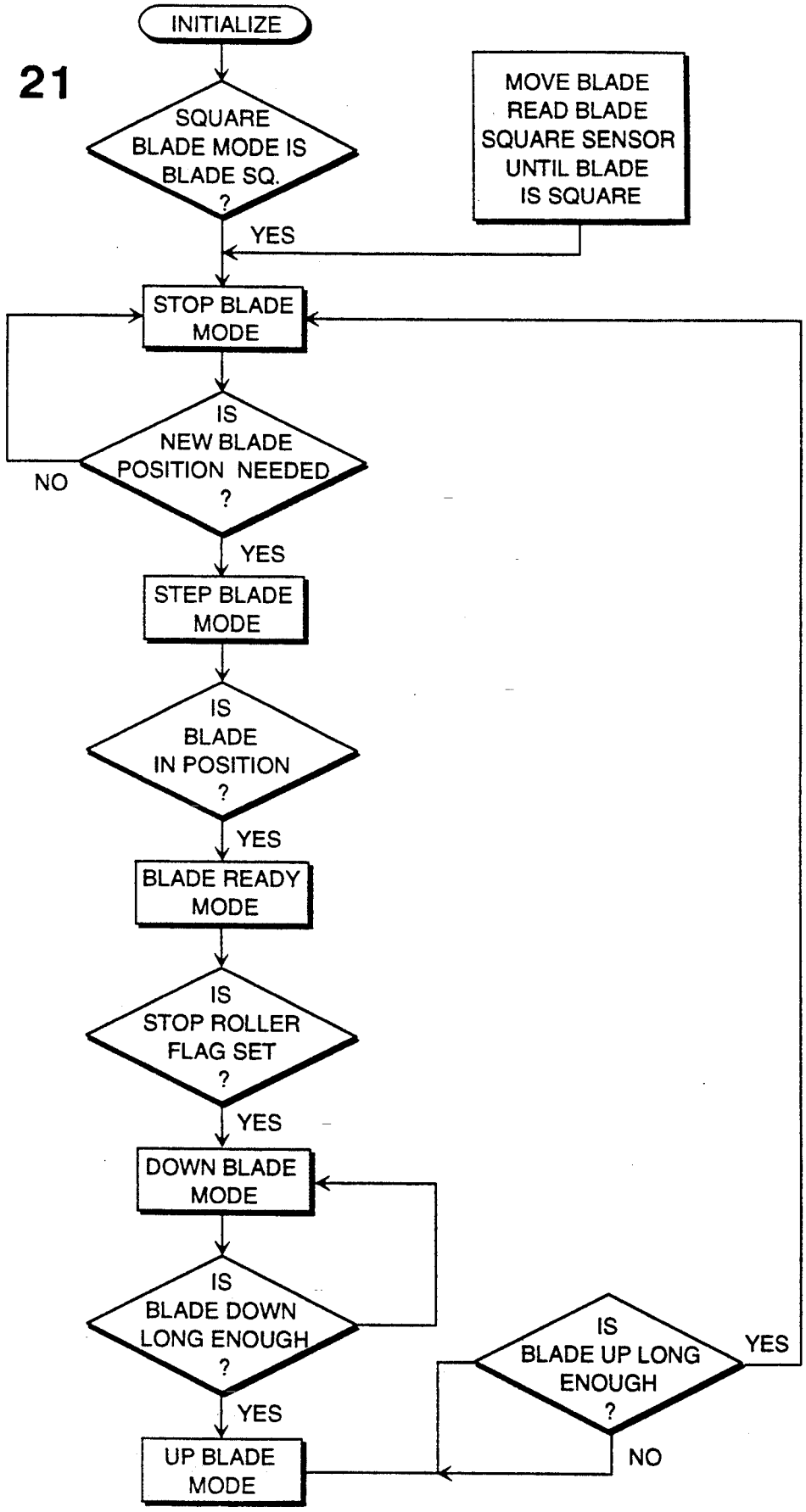
FIG. 21 illustrates in detail the blade interrupt handler portion of the program shown as a single block in FIG. 19.

FIG. 21—Blade Interrupt Handler

When the blade timer 44-5' (FIG. 14) generates an interrupt, the blade interrupt handler is called into operation. This handler can be thought of as handling all control and positioning functions for the blade 14. On initialization, the handler squares the blade, i.e., establishes a reference by reading the sensor 49 (FIG. 18) on the machine frame which tells the controller the blade 14 is square to the frame. After this operation, the controller remembers the blade position as it is moved and thereby avoids periodic re-squaring of the blade. In normal operation, a separate part of the program reads the sensors and calculates a new blade position; that is, the "correct" angle of the blade for the next cut. When the "new blade position", as determined by that routine, becomes available, the blade interrupt handler, when called, checks to see if the "current" blade position agrees with the "new" blade position. If they are different, indicating the blade angle needs to be adjusted, the blade mode is set to "not ready" and the handler steps the blade angle in the desired direction (step blade mode). Eventually, the blade 14 will reach its destination, and when the interrupt handler detects this, the blade ready mode is entered, signifying that the blade is ready to cut. If the roller interrupt handler also indicates that the rollers 20 are ready for a cut (roller ready mode), the blade UP/DOWN modes are executed as described in connection with the FIGS. 1-4 embodiments of the invention. This is the routine that activates the blade DOWN/UP modes stroke of the blade to actually cut the material.

In summary, the roller interrupt handler controls all roller positioning duties under the control of a roller timer. The blade is controlled by the blade interrupt handler. Each handler sets a flag to indicate if the roller and/or the blade are "in position" and ready to cut. When both the roller and blade status are ready, the actual cut sequence is initiated. Both roller and blade position are determined by mathematical operations and formulae obtained as part of the "READ EYES" operation. Reading of the "EYES" is done as part of the roller interrupt handler since this must occur on each machine step.

Figure 22:
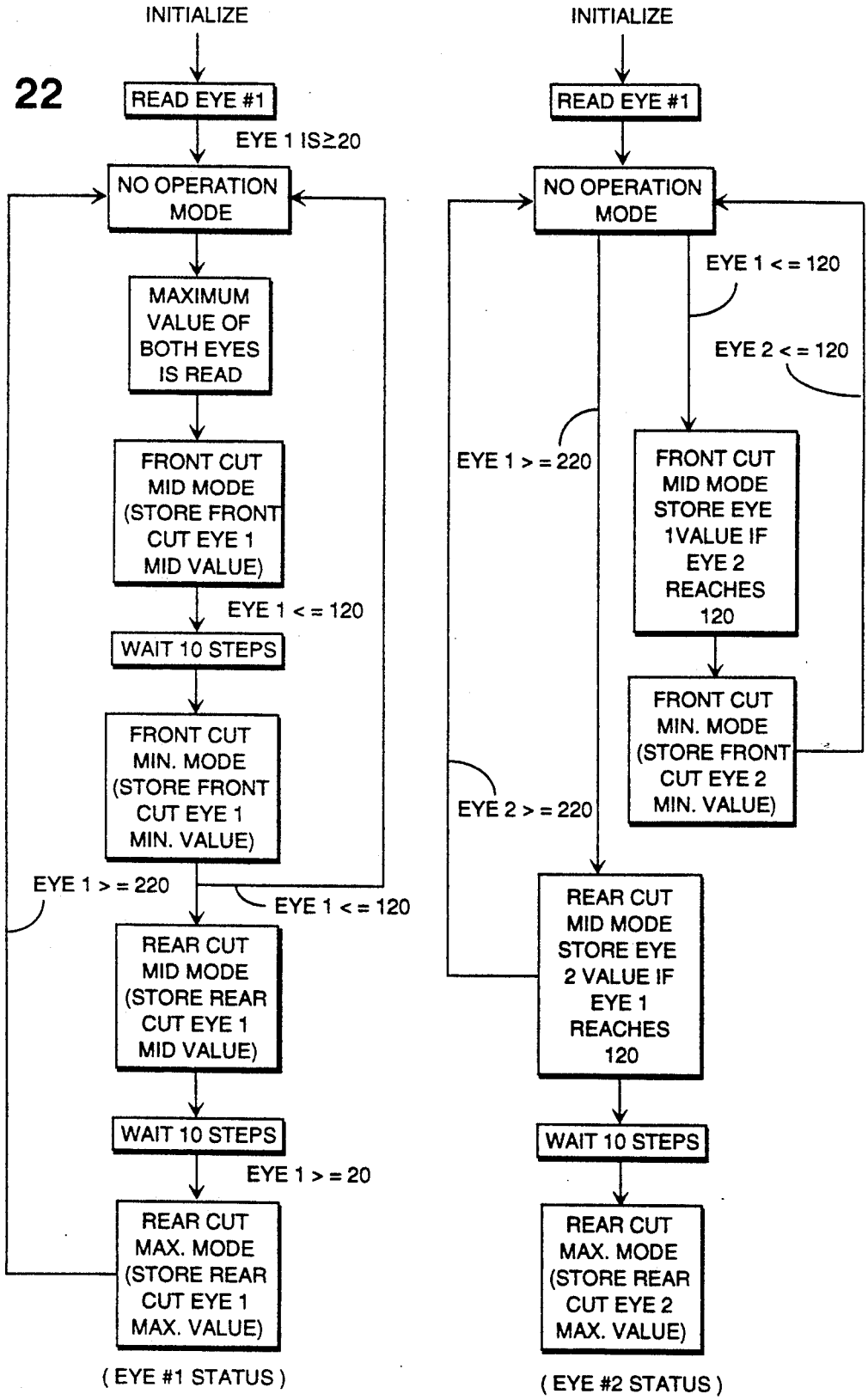
FIG. 22 illustrates the "read eyes" portion of the program indicated as a single block in FIG. 19.

FIG. 22—Read Eyes State Diagram

FIG. 22 is easier to understand if it is remembered that the analog eye readings are passed through an analog/digital converter 44c (FIG. 18). Its output can be a number from 0 through 255, and that a low number (less than 10) is read when a sensor slot is completely covered, and that a high number (greater than 220) is read when a sensor slot is completely uncovered. A "MID" reading of 120 would indicate a sensor which is about half-covered (or half-uncovered).

Before getting into detail about FIG. 22, a recall that the theory behind analog sensing of the sheet angle was that a "snapshot" is taken of the sensor outputs and the two resulting analog voltages from those sensors could be used for high-resolution measuring of the sheet angle. The task of the controller (which includes a microprocessor) is to measure the "normalize" slot readings to accurately measure the edge angle when a sheet is approximately half-covering or uncovering one of the slots.

FIG. 22 illustrates that each sensor is read on each roller step. As a starting point, assume that sensor 1 is either less than 20, indicating it is covered completely, or that it is greater than 220, indicating it is open completely. This "no operation" mode indicates that an edge is not actively crossing the sensor slots.

The "NO" operation mode is exited when the output of one of the sensors crosses the threshold 120 either going down from an open condition or up from a closed condition. In other words, when a sensor output crosses the threshold 120, indicating the associated slot is about half-covered, the snapshot is taken; that is, the outputs of both sensors PC1 and PC2 are read, and their respective "MID" values are stored. If this threshold is crossed going down, it is read as a front cut (front cut mid mode) and if crossed going up, it is read as a rear cut (rear cut mid mode). All that remains is to get the MAX and MIN sensor readings for both sensors. This may be accomplished as follows:

Ten steps after a front cut mid value is read where both slots are covered, the sensors are read again and the "MIN" values are assigned to the sensors are stored.

The steps after a rear cut mid value is read assuring that the slots are completely uncovered, the "MAX" values of the sensors are measured and stored.

In other words, the Read Eyes routine extracts and stores the following numbers while a sheet is stepped across the slot-eyes:

a. Eye 1 Mid—Eye 1 PC1 sensor output when sheet edge approximately half-covers slot SL2.
b. Eye 2 Mid—Eye 2 PC2 sensor output when sheet edge approximately half-covers slot SL1.
c. Eye 1 Max—Maximum (clear) value for sensor 1.
d. Eye 2 Max—Maximum (clear) value for sensor 1.
e. Eye 1 Min—Minimum (dark) value for sensor 1.
f. Eye 2 Min—Minimum (dark) value for sensor 2.

With these values, the program proceeds to the normalization routine, where absolute positioning capability of the measurements can be restored, and the roller and blade positions can be calculated in accordance with the equations previously described.

The "Read Eyes" state diagram of FIG. 22 shows various other functions performed by the program, which functions for the most part have already been described.

Figure 23:
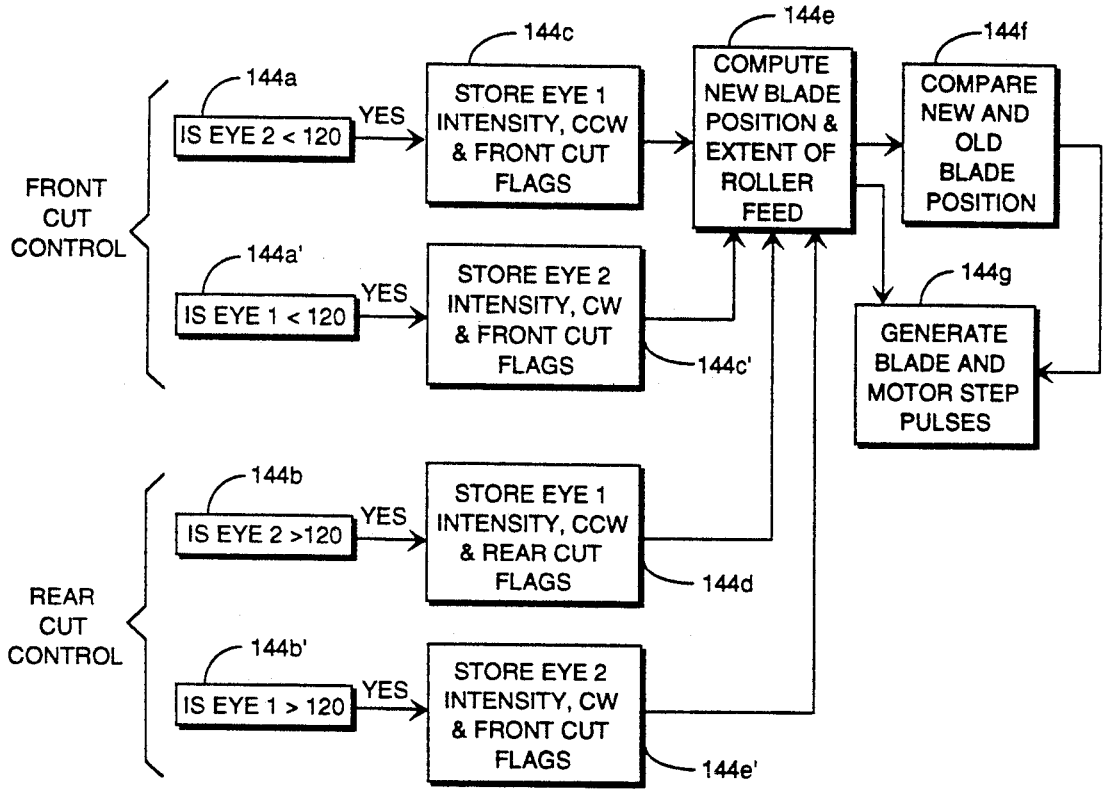
FIG. 23 is a summary of the more important of the steps carried out by the program shown in more detail in the other figures.

FIG. 23—Program Summary Diagram

FIG. 23 is a summary of the most important program steps shown in much more detail than the previous figures. Thus, in FIG. 23, blocks **144*a*-144*a'* are the front cut control program steps which inquire whether it is the output of light sensor PC2 or PC1 which decreases to 120 to indicate whether the leading edge involved has a counterclockwise or clockwise angle with respect to the line L2 connecting the mid points of the slots SL2 and SL1. Similarly, the blocks 144*b*-144*b'* are the rear cut program control steps which inquire whether it is the output of light sensor PC2 or PC1 which increases to 120. These program steps control program steps identified by the blocks 144*c*-144*c'* and 144*d*-144*d'* wherein the output of the sensor other than the sensor which first produces the output 120 is stored along with flags which indicate whether a counterclockwise or clockwise rotation of the blade appears to be called for, and a flag indicating whether a rear cut or front cut mode is involved. After this storage operation takes place, the steps of the program perform the various required computations identified in block 144*e* come into operation including the normalization corrections referred to. These compute the angle of the edge involved and the distance which the center of the edge involved must be moved to bring it into a desired position adjacent the blade 14**.

Next, the program steps identified in block 144*f* compare the computed blade angle with the current blade angle position and generates the necessary signals which produce the required number of pulses necessary to step the blade motor the proper number of steps to rotate the motor shaft in the proper direction. Also, the results of the computations carried out by the program steps identified in block 144*e* produce the number of pulses needed to step the roller step motor 40 to bring the center of the sheet edge opposite the blade 14. These pulses are produced by the program steps contained with the block 144*g*.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details.

PROGRAM DETAILS FOR FIGS. 1-4 EMBODIMENT

```
2500 A.D. COPS 400 CROSS ASSEMBLER  -  VERSION 3.01b
----------------------------------------------

        INPUT  FILENAME :  BLADE.SRC
        OUTPUT FILENAME :  BLADE.OBJ


                        .TITLE ANGLING BLADE CONTROL PROGRAM-- VERSION 1.0
                        ;*************************************************************
                        ;* Program to control the infamous "Angling Blade"          *
                        ;*                                                           *
                        ;* Designed to work with the "Accu II New" Main Controller  *
                        ;*                                                           *
                        ;* Written October 24, 1988 for D&K Custom Machine Design Inc.*
                        ;* by M. Flasza Cecomp Electronic Design, Inc.              *
                        ;*                                                           *
                        ;* All Rights Reserved                                      *
                        ;*                                                           *
                        ;*************************************************************
                        ;
                               .LIST ON
                               .CHIP   420
0000                           .ORG    0000H
0000   00                              CLRA            ;FIRST INST. MUST BE CLRA
0001   33 5F                           OGI     15      ;SET G PORT AS INPUT
0003   80                              JSRP    CLRAM   ;CLEAR ALL RAM ON POWER-UP
0004   33 64                           LEI     4       ;ENABLE L OUTPUTS
0006   60 A7                           JSR     SQBLD   ;SQUARE BLADE
0008   33 11                   HOLD:   SKGBZ   1       ;WAIT FOR 1ST PULSE
000A   C8                              JP      HOLD
000B   44                              NOP             ;DELAY 16 uS
000C   44                              NOP
000D   33 28                           ININ            ;READ IN (eye) INPUTS
000F   12                              XABR            ;CLEAR A3, A2
0010   12                              XABR
0011   23 99                           XAD     1,9     ;SAVE INITIAL EYE STATUS
0013   33 11                   WAIT:   SKGBZ   1       ;WAIT FOR STR TO RESET
0015   D7                              JP      START
0016   D3                              JP      WAIT
```

```
0017  33 11          START:  SKGBZ   1        ;TEST STR, SKIP IF LOW
0019  D7                     JP      START
001A  44             GO:     NOP              ;DELAY 16 uS
001B  44                     NOP
001C  33 28                  ININ             ;READ IN (eye) INPUTS
001E  12                     XABR             ;CLEAR A3, A2
001F  12                     XABR
0020  33 3C                  CAMQ             ;SERVICE EYE INDICATOR LITES
00[illegible]  18                     LBI     1,9      ;POINT TO "LAST EYE STATUS"
00[illegible]  21                     SKE              ;TEST FOR EYE CHANGE
0024  69 40          EYECH:  JSR EYEDEC       ;EYE CHANGED--GO TO DECODE ROUTINE
0026  38                     LBI     3,9      ;POINT TO FLAG BOX 1
0027  01                     SKMBZ   0        ;SKIP IF RCC NOT ENABLED
0028  98                     JSRP    INCRCC   ;INCREMENT REAR CUT COUNTER
0029  38                     LBI     3,9      ;RE-POINT TO FLAG BOX 1
002A  03                     SKMBZ   2        ;SKIP IF FCC NOT ENABLED
002B  89                     JSRP    INCFCC   ;INCREMENT FRONT CUT COUNTER
002C  39             CREADY: LBI     3,10     ;POINT TO FLAG BOX 2
002D  01                     SKMBZ   0        ;SKIP IF RCC NOT READY
002E  F4                     JP      RCCR     ;REAR CUT COUNTER IS READY
002F  11             RCCNR:  SKMBZ   1        ;SKIP IF FCC NOT READY
0030  69 6F                  JSR     MFC      ;MOVE TO FRONT CUT POSITION
0032  60 17                  JMP     START    ;GO BACK TO START
0034  11             RCCR:   SKMBZ   1        ;SKIP IF FCC NOT READY
0035  FC                     JP      FCCR
0036  44             FCCNR:  NOP
0037  44                     NOP
0038  44                     NOP              ;What goes here ??
0039  44                     NOP
003A  60 17                  JMP     START    ;GO BACK TO START
003C  69 C9          FCCR:   JSR     MRC      ;MOVE TO REAR CUT POSITION
003E  60 17                  JMP     START    ;GO BACK TO START
                     ;
                     ;*** END OF MAIN PROGRAM ***
                     ;
                     .PAGE
                     ; Place following subroutines on Page Two
0080                 .ORG    0080H
                     ;
                     ;SUBROUTINE CLRAM
                     ;Subroutine to clear all RAM on power-up
                     ;
0080  3E             CLRAM:  LBI     3,15
0081  00             CLR:    CLRA
0082  07                     XDS
0083  81                     JP      CLR
0084  12                     XABR
0085  5F                     AISC    15
0086  48                     RET
0087  12                     XABR
0088  81                     JP      CLR
                     ;
                     ;SUBROUTINES INCFCC, INCRCC
                     ;Subroutines to increment a two-byte binary RAM counter
                     ;
0089  2A             INCFCC: LBI     2,11     ;POINT TO LOW BYTE FCC
008A  05                     LD               ;BRING LOW BYTE TO A
008B  51                     AISC    1        ;INCREMENT, SKIP IF CARRY
008C  92                     JP      NOCARY   ;NO CARRY-- JUMP AHEAD
008D  04                     XIS              ;PUT 0 IN LSB, POINT TO MSB
```

```
00BE  05                    LD              ;BRING MSB TO A
00BF  51                    AISC    1       ;INCREMENT MSB
00C0  92                    JP      NOCARY
00C1  94                    JP      OVFL    ;COUNTER OVERFLOWED
00C2  06                NOCARY: X           ;PUT INCR. BYTE BACK
00C3  48                    RET             ;RETURN
00C4  06                OVFL:   X           ;PUT 0 BACK IN MSB
00C5  38                    LBI     3,9     ;POINT TO FLAG BOX 1
00C6  42                    RMB     2       ;DISABLE FCC
00C7  48                    RET             ;RETURN
00C8  3A                INCRCC: LBI     3,11    ;POINT TO LOW BYTE RCC
00C9  05                    LD
00CA  51                    AISC    1
00CB  A1                    JP      NCARY
00CC  04                    XIS
00CD  05                    LD
00CE  51                    AISC    1
00CF  A1                    JP      NCARY
00A0  A3                    JP      DOVFL
00A1  06                NCARY:  X
00A2  48                    RET
00A3  06                DOVFL:  X
00A4  38                    LBI     3,9
00A5  4C                    RMB     0       ;DISABLE RCC
00A6  48                    RET
                        ;
                        ;SUBROUTINE SQBLD
                        ;Subroutine to square blade by monitoring Blade Square
                        ;Sensor (BSS) and jogging blade accordingly. Also stores
                        ;nominal value in Blade Position Counter (RAM(0,9) and
                        ;(0,10)) when done.
                        ;
00A7  33 01             SQBLD:  SKGBZ   0       ;SKIP IF BSS=0 (blade too far CCW)
00A9  BE                    JP      MCCW    ;BSS=1 (blade too far CW)
00AA  33 08             MCW:    LBI     0,8     ;PRELOAD B WITH "8"
00AC  33 3E                 OBD             ;SET DIR BIT TO 1
00AE  68 D6             LOOP:   JSR     DLY2MS  ;DELAY 2mS
00B0  33 01                 SKGBZ   0       ;SKIP IF BSS=0
00B2  D2                    JP      RSBPC   ;BLADE SQUARED:RESET POSITION COUNTER
00B3  0B                    LBI     0,12    ;PRELOAD B WITH "12"
00B4  33 3E                 OBD             ;TURN ON MOTOR PULSE,LEAVE DIR=1
00B6  44                    NOP             ;DELAY 12uS
00B7  44                    NOP
00B8  44                    NOP
00B9  33 08                 LBI     0,8     ;PRELOAD B WITH "8"
00BB  33 3E                 OBD             ;TOTAL PUSE WIDTH=20uS
00BD  AE                    JP      LOOP
00BE  0F                MCCW:   LBI     0,0     ;PRELOAD B WITH "0"
00BF  33 3E                 OBD             ;SET DIR BIT TO 0
00C1  68 D6             LOOP1:  JSR     DLY2MS  ;DELAY 2mS
00C3  33 01                 SKGBZ   0       ;SKIP IF BSS=0
00C5  C7                    JP      NEXT
00C6  D2                    JP      RSBPC
00C7  33 04             NEXT:   LBI     0,4     ;PRELOAD B WITH "4"
00C9  33 3E                 OBD             ;TURN ON STROBE,LEAVE DIR=0
00CB  44                    NOP
00CC  44                    NOP             ;DELAY 12uS
00CD  44                    NOP
00CE  0F                    LBI     0,0     ;PRELOAD B WITH "0"
00CF  33 3E                 OBD             ;TURN OFF STROBE
```

```
00D1  C1                    JP      LOOP1
00D2  08                RSBPC: LBI     0,9     ;POINT TO LOW BYTE BPC
00D3  70                       STII    0       ;STORE 0 @ LSB
00D4  70                       STII    0       ;STORE 0 @ MSB
00D5  48                       RET
                        ;
                        ;SUBROUTINE DLY2MS
                        ;Subroutine to generate approx. 1mS delay
                        ;
00D6  3F                DLY2MS: LBI    3,0     ;POINT TO TIMER COUNTER
00D7  74                       STII    4       ;PRESET TIMER COUNTER
00D8  00                       CLRA
00D9  51                LOOPX: AISC    1       ;DELAY 2X4X16=128uS
00DA  D9                       JP      LOOPX
00DB  23 B0                    XAD     3,0     ;PUT 0 IN RAM, BRING TC TO A
00DD  51                       AISC    1       ;INCREMENT TC
00DE  E0                       JP      NEXTX
00DF  48                       RET
00E0  23 B0             NEXTX: XAD     3,0     ;PUT INCR. TC BACK IN RAM
00E2  D9                       JP      LOOPX
                        .PAGE
                        ;SUBROUTINE EYEDEC
                        ;Decodes all 16 possible eye change patterns and jumps
                        ;to necessary decode routine. On entry, A has "Latest
                        ;Eye Status" in A1 and A0, 0 in A2 and A3. B points to
                        ;"Last Eye Status". Subroutine then sets or resets necessary
                        ;Control Flags in two RAM flag boxes.
                        ;
                        ;First part of subroutine is address lookup table for JID
                        ;
0100                    .ORG   0100H
0100  6D                .BYTE  6DH          ;ADDRESS OF CASE 0 (No Change)
0101  4E                .BYTE  4EH          ;ADDRESS OF CASE 4
0102  4E                .BYTE  4EH          ;ADDRESS OF CASE 8 (Same as Case 4)
0103  60                .BYTE  60H          ;ADDRESS OF CASE 12
0110                    .ORG   0110H
0110  41                .BYTE  41H          ;ADDRESS OF CASE 1
0111  6D                .BYTE  6DH          ;ADDRESS OF CASE 5 (No Change)
0112  5C                .BYTE  5CH          ;ADDRESS OF CASE 9
0113  65                .BYTE  65H          ;ADDRESS OF CASE 13
0120                    .ORG   0120H
0120  45                .BYTE  45H          ;ADDRESS OF CASE 2
0121  53                .BYTE  53H          ;ADDRESS OF CASE 6
0122  6D                .BYTE  6DH          ;ADDRESS OF CASE 10 (No Change)
0123  69                .BYTE  69H          ;ADDRESS OF CASE 14
0130                    .ORG   0130H
0130  49                .BYTE  49H          ;ADDRESS OF CASE 3
0131  57                .BYTE  57H          ;ADDRESS OF CASE 7
0132  57                .BYTE  57H          ;ADDRESS OF CASE 11 (Same as Case 7)
0133  6D                .BYTE  6DH          ;ADDRESS OF CASE 15 (No Change)
0140                    .ORG   0140H
0140  FF                EYEDEC: JID         ;JUMP INDIRECT TO DECODE ROUTINE
0141  38                CASE1: LBI     3,9     ;POINT TO FLAG 1
0142  46                       SMB     2       ;ENABLE FCC
0143  43                       RMB     3       ;ANGLE IS -, RESET DIR BIT
0144  EC                       JP      COM
0145  38                CASE2: LBI     3,9     ;POINT TO FLAG 1
0146  46                       SMB     2       ;ENABLE FCC
0147  4B                       SMB     3       ;ANGLE IS +, SET DIR BIT
0148  EC                       JP      COM
```

```
0149  39          CASE3:  LBI   3,10   ;POINT TO FLAG 2
014A  47                  SMB   1     ;SET FCC READY FLAG
014B  38                  LBI   3,9   ;POINT TO FLAG 1
014C  42                  RMB   2     ;DISABLE FCC
014D  EC                  JP    COM
014E  39          CASE4:  LBI   3,10  ;POINT TO FLAG 2
014F  4D                  SMB   0     ;SET RCC READY FLAG
0150  38                  LBI   3,9   ;POINT TO FLAG 1
0151  4C                  RMB   0     ;DISABLE RCC
0152  EC                  JP    COM
0153  38          CASE6:  LBI   3,9   ;POINT TO FLAG 1
0154  46                  SMB   2     ;ENABLE FCC
0155  4B                  SMB   3     ;SET FC (+) FLAG
0156  CE                  JP    CASE4
0157  39          CASE7:  LBI   3,10  ;POINT TO FLAG 2
0158  47                  SMB   1     ;SET FCC READY FLAG
0159  38                  LBI   3,9   ;POINT TO FLAG 1
015A  42                  RMB   2     ;DISABLE FCC
015B  EC                  JP    COM
015C  38          CASE9:  LBI   3,9
015D  46                  SMB   2     ;ENABLE FCC
015E  43                  RMB   3     ;ANGLE IS (-), RESET FLAG
015F  CE                  JP    CASE4
0160  39          CASE12: LBI   3,10
0161  4D                  SMB   0     ;SET RCC READY FLAG
0162  38                  LBI   3,9
0163  4C                  RMB   0     ;DISABLE RCC
0164  EC                  JP    COM
0165  38          CASE13: LBI   3,9
0166  4D                  SMB   0     ;ENABLE RCC
0167  47                  SMB   1     ;ANGLE IS (+), SET DIR BIT
0168  EC                  JP    COM
0169  38          CASE14: LBI   3,9
016A  4D                  SMB   0
016B  45                  RMB   1     ;ANGLE IS (-)
016C  23 99       COM:    XAD   1,9   ;SAVE LATEST TO "LAST" EYE STATUS
016E  48          NC:     RET         ;PLAIN RETURN FOR NO EYE CHANGE
                  .PAGE
                ;SUBROUTINES MFC, MRC
                ;Subroutines to move blade, when called, into position for
                ;Front and Rear Cuts.
                ;
016F  68 A7       MFC:    JSR   SQBLD ;SQUARE BLADE FIRSTT
0171  6A 13               JSR   FUDGE ;Front Cut Fudge Factor
0173  00          TEST:   CLRA        ;CLEAR A FOR COUNTER TEST
0174  2A                  LBI   2,11  ;POINT TO FCC LSB
0175  21                  SKE         ;SKIP IF ZERO
0176  61 89               JMP   NZ    ;LSB NOT ZERO
0178  2B                  LBI   2,12  ;POINT TO FCC MSB
0179  21                  SKE         ;SKIP IF MSB IS ZERO
017A  61 89               JMP   NZ    ;MSB IS NOT ZERO
017C  39          ZERO:   LBI   3,10  ;FCC IS ZERO
017D  45                  RMB   1     ;RESET FCC READY FLAG
017E  33 81               LBI   0,1   ;PRELOAD B WITH "1"
0180  33 3E               OBD         ;SET BLADE READY SIGNAL
0182  33 13       WTE:    SKGBZ 3     ;TEST EXIT INPUT
0184  C2                  JP    WTE   ;WAIT FOR EXIT SIGNAL TO GO LOW
0185  0F          DUN:    LBI   0,0   ;PRELOAD 0
0186  33 3E               OBD         ;RESET BLADE READY SIGNAL
0188  48                  RET
```

```
273  0189  2A                NZ:     LBI     2,11    ;DECREMENT FCC
274  018A  69 BA                     JSR     DEC
275        00 00             MU:     EQUAL   0
276        00 03             MT:     EQUAL 3
277                     ;This program uses a macrostep count of 47dec (3BH)
278                     ;i.e.,angular resolution of blade motor is 48 times as great
279                     ;as angular resolution of roller step/eye spacing
280                     ;
281  018C  28                MACCRO: LBI     2,9     ;PRELOAD M
282  018D  70                        STII    MU
283  018E  73                        STII    MT
284  018F  68 D6             MLOOP:  JSR     DLY2MS  ;DELAY 2mS
285  0191  38                        LBI     3,9     ;POINT TO FLAG 1
286  0192  13                        SKMBZ   3       ;TEST DIR FLAG
287  0193  E1                        JP      STEPCW  ;BLADE MUST BE MOVED CW
288  0194  0F                STEPCCW:LBI     0,0     ;RESET DIR BIT FOR CCW
289  0195  33 3E                     OBD             ;SEND TO OUTPUT
290  0197  33 84                     LBI     0,4     ;PRELOAD B
291  0199  33 3E                     OBD             ;TURN ON STEP PULSE,LEAVE DIR=CCW
292  019B  69 C4                     JSR     DLY64   ;DELAY 64uS
293  019D  0F                        LBI     0,0     ;PRELOAD B
294  019E  33 3E                     OBD             ;TURN OFF STEP PULSE
295  01A0  EE                        JP      DECMC   ;DECREMENT MACROSTEP COUNTER
296  01A1  33 88             STEPCW: LBI     0,8     ;BLADE MUST MOVE CW
297  01A3  33 3E                     OBD             ;SET DIR OUTPUT TO 1 (CW)
298  01A5  0B                        LBI     0,12    ;PRELOAD B
299  01A6  33 3E                     OBD             ;TURN ON STEP PULSE
300  01A8  69 C4                     JSR     DLY64   ;DELAY 64uS
301  01AA  33 88                     LBI     0,8     ;PRELOAD B
302  01AC  33 3E                     OBD             ;TURN OFF STEP PULSE
303  01AE  28                DECMC:  LBI     2,9     ;POINT TO MACROSTEP COUNTER
304  01AF  69 BA                     JSR     DEC     ;DECREMENT
305  01B1  00                TESTMC: CLRA
306  01B2  28                        LBI     2,9     ;POINT TO MC LSB
307  01B3  21                        SKE             ;TEST, SKIP IF LSB=0
308  01B4  CF                        JP      MLOOP   ;NOT ZERO, GO BACK
309  01B5  29                        LBI     2,10    ;POINT TO MC MSB
310  01B6  21                        SKE             ;TEST
311  01B7  CF                        JP      MLOOP   ;NOT ZERO, GO BACK
312  01B8  61 73                     JMP     TEST    ;ZERO,MACROSTEPS DONE
313                             ;SUBROUTINE DEC
314                             ;Subroutine to decrement a two-byte binary RAM Counter
315                             ;On entry, B must point to counter LSB
316                             ;
317  01BA  32                DEC:    RC
318  01BB  00                        CLRA
319  01BC  10                        CASC
320  01BD  44                        NOP
321  01BE  04                        XIS
322  01BF  00                        CLRA
323  01C0  10                        CASC
324  01C1  44                        NOP
325  01C2  06                        X
326  01C3  48                        RET
327                             ;SUBROUTINE DLY64
328                             ;Subroutine to generate 64uS delay
329                             ;
330  01C4  00                DLY64:  CLRA
331  01C5  52                DCRAP:  AISC    2
332  01C6  61 C5                     JMP     DCRAP
```

```
01C8  48                    RET
                      .PAGE
01C9  68 A7           MRC:  JSR     SQBLD   ;sQUARE BLADE FIRST
01CB  00              TEST2: CLRA
01CC  3A                    LBI     3,11
01CD  21                    SKE
01CE  DF                    JP      NZ2
01CF  3B                    LBI     3,12
01D0  21                    SKE
01D1  DF                    JP      NZ2
01D2  39              ZERO2: LBI    3,10
01D3  4C                    RMB     0
01D4  33 81                 LBI     0,1
01D6  33 3E                 OBD
01D8  33 13           WTE2: SKGBZ   3
01DA  DB                    JP      WTE2
01DB  0F              DUN2: LBI     0,0
01DC  33 3E                 OBD
01DE  48                    RET
01DF  3A              NZ2:  LBI     3,11
01E0  69 BA                 JSR     DEC
01E2  28              MACCRO2:LBI   2,9
01E3  70                    STII    MU
01E4  73                    STII    MT
01E5  68 D6           MLOOP2: JSR   DLY2MS
01E7  38                    LBI     3,9
01E8  11                    SKMBZ   1
01E9  FB                    JP      STEPCW2
01EA  0F              STPCCW2:LBI   0,0
01EB  33 3E                 OBD
01ED  33 84                 LBI     0,4
01EF  33 3E                 OBD
01F1  69 C4                 JSR     DLY64
01F3  0F                    LBI     0,0
01F4  33 3E                 OBD
01F6  62 05                 JMP     DECMC2
01F8  33 88           STEPCW2:LBI   0,8
01FA  33 3E                 OBD
01FC  0B                    LBI     0,12
01FD  33 3E                 OBD
01FF  69 C4                 JSR     DLY64
0201  33 88                 LBI     0,8
0203  33 3E                 OBD
0205  28              DECMC2: LBI   2,9
0206  69 BA                 JSR     DEC
0208  00              TESTMC2:CLRA
0209  28                    LBI     2,9
020A  21                    SKE
020B  61 E5                 JMP     MLOOP2
020D  29                    LBI     2,10
020E  21                    SKE
020F  61 E5                 JMP     MLOOP2
0211  61 CB                 JMP     TEST2
                ;     SUBROUTINE FUDGE
                ;     Subroutine to cheat on front cut by "re-squaring"
                ;     or "offsetting" blade by fixed amount (basically
                ;     "trimming" Front Cut only
0213  0D              FUDGE: LBI    0,14    ;POINT TO FUDGE CTR
      00 00                   FULSB: EQUAL  0
```

```
392          00 06                    FUMSB:  EQUAL   6       ;PRESET FUDGE CTR TO 96dec
393   0214   70                       STII    FULSB
394   0215   76                       STII    FUMSB           ;STORE IN RAM
395   0216   33 B8                    LBI     8,8     ;PRELOAD B
396   0218   33 3E                    OBD             ;SET DIR=CW
397   021A   68 D6              FULOOP: JSR     DLY2MS  ;DELAY 2mS
398   021C   8D                       LBI     8,12    ;PRELOAD B
399   021D   33 3E                    OBD             ;TURN ON STEP, LEAVE DIR=CW
400   021F   44                       NOP
401   0220   44                       NOP
402   0221   44                       NOP             ;DELAY 16uS
403   0222   33 B8                    LBI     8,8     ;PRELOAD B
404   0224   33 3E                    OBD             ;TURN OFF STEP
405   0226   8D                       LBI     8,14    ;POINT TO FUDGE CTR
406   0227   69 BA                    JSR     DEC     ;DECREMENT FUDGE CTR
407   0229   8D                 FUCTEST:LBI   8,14    ;POINT TO FUDGE CTR LSB
408   022A   80                       CLRA
409   022B   21                       SKE
410   022C   DA                       JP      FULOOP
411   022D   8E                       LBI     8,15
412   022E   21                       SKE
413   022F   DA                       JP      FULOOP
414   0230   48                       RET
415   0231                      .END
```

```
2500 A.D. COPS 400 CROSS ASSEMBLER  -   VERSION 3.01b
-------------------------------------------------------

        INPUT  FILENAME :  ACU2NU.SRC
        OUTPUT FILENAME :  ACU2NU.OBJ
```

```
 1                        .TITLE ACCUMATIC II-NEW CONTROL PROGRAM--  VERSION 2.5
 2                        ;*****************************************************
 3                        ;*                                                   *
 4                        ;*  Control Program for Accumatic ii with Custom Keybd. *
 5                        ;*  and Display, and prov. to interface w/BLADE CONTROL *
 6                        ;*  Custom Written for D&K Custom Machine Design Inc.  *
 7                        ;*  Written by M. Flasza Cecomp Electronic Design Inc. *
 8                        ;*  August 26, 1988 All Rights Reserved--[redacted]  *
 9                        ;*  [redacted]                                       *
10                        ;*                                                   *
11                        ;*****************************************************
12                        ;
13                                 .LIST ON
14                                 .CHIP 420
15   0000                          .ORG    0000H
16   0000   80                     CLRA
17   0001   33 5F                  OGI     15      ;Set G Port as input
18   0003   69 EA                  JSR     CLRAM   ;Clear all RAM on power-up
19   0005   33 68                  LEI     8       ;Set L Port as input
20                                                 ;Set SIO as Shift reg.
21                                                 ;Set SO as Shift reg. Out
22          00 00             FCDU:   EQUAL   0       ;Front Cut Default = 10
23          00 01             FCDT:   EQUAL   1
24          00 00             RCDU:   EQUAL   0       ;Rear Cut Default = 10
25          00 01             RCDT:   EQUAL   1
```

```
26          00 02          SPDU:  EQUAL  2      ;Speed Default Value=32
27          00 03          SPDT:  EQUAL  3
28          00 00          SPBU:  EQUAL  0      ;Binary equiv. of SPEED setting for
29          00 02          SPBT:  EQUAL  2      ;use as binary "Shadow Counter"
30          00 0A          BLNK:  EQUAL  AH     ;This value blanks display digit
31  0007    33 A5                 LBI    2,5
32  0009    70                    STII   FCDU   ;Store Front Cut Default values
33  000A    71                    STII   FCDT   ;@ RAM(2,5),(2,6)
34  000B    7A                    STII   BLNK
35  000C    7A                    STII   BLNK
36  000D    33 B5                 LBI    3,5
37  000F    70                    STII   RCDU   ;Store Rear Cut Default values
38  0010    71                    STII   RCDT   ;@ RAM (3,5),(3,6)
39  0011    7A                    STII   BLNK
40  0012    7A                    STII   BLNK
41  0013    33 93                 LBI    1,3
42  0015    70                    STII   SPBU
43  0016    72                    STII   SPBT
44  0017    72                    STII   SPDU   ;Store Speed Default values
45  0018    73                    STII   SPDT   ;@ RAM (1,5),(1,6)
46  0019    7A                    STII   BLNK   ;Store "blank" values to make
47  001A    7A                    STII   BLNK   ;Speed, Front Cut, and Rear Cut
48  001B    69 3C                 JSR    MATH   ;Calculate RCD+RC,FCD-FC
49  001D    68 C0                 JSR    PWRCHK ;Jump to check for power-on
50  001F    33 01          START: SKGBZ  0      ;Check if power is on
51  0021    68 C0                 JSR    PWRCHK ;Power is off
52  0023    1E             GOON:  LBI    1,15   ;Point to Outputs Work Area
53  0024    4D                    SMB    0      ;Set bit to turn on strobe
54  0025    05                    LD            ;Bring to A
55  0026    50                    CAB           ;Copy to Bd
56  0027    33 3E                 OBD           ;Turn on Strobe;EFSS if flag is set
57  0029    2F                    LBI    2,0    ;Point to "Latest Eye Status" box
58  002A    06                    X             ;Save Outputs data @ RAM(2,0)
59  002B    4C                    RMB    0      ;Reset strobe bit in RAM
60  002C    33 28                 ININ          ;Read I inputs (eye data) to A
61  002E    06                    X             ;Store I data to RAM, restore Output
62                                              ;data to A
63  002F    50                    CAB           ;Send new Outputs data to B
64  0030    33 3E                 OBD           ;Turn off Strobe
65  0032    41             CHKTIM: SKT          ;Test Time Base Counter
66  0033    FD                    JP     NOKEY  ;Not time to svc. kbd/disp yet
67  0034    3E                    LBI    3,15   ;Service keybd or disp every 4mS
68  0035    13                    SKMBZ  3      ;Flag Box bit 3=0 means display
69  0036    FB                    JP     DNUPD  ;doesn't need service--do keybd
70  0037    6B D5                 JSR    HLTCHK ;Poll for Halt flags
71  0039    6A 40                 JSR    KBDSVC ;instead--Bit 3=1 means display
72                                              ;needs service--don't do keybd
73  003B    69 70          DNUPD: JSR    DISUPD ;Update Display
74  003D    1F             NOKEY: LBI    1,0    ;Point to "Last Eye Status" box
75  003E    01                    SKMBZ  0      ;Test Last Eye Status, skip if 0
76  003F    C4                    JP     LIS1   ;Last Eye Status was 1
77  0040    2F             LIS0:  LBI    2,0    ;Last Eye Status was 0
78                                              ;Point to Latest Eye Status box
79  0041    01                    SKMBZ  0      ;If Latest Eye Status was 1,
80  0042    C7                    JP     YESICH ;Eye changed
81  0043    CA                    JP     NOICH  ;If Latest Eye Status was 0,
82                                              ;eye did not change
83  0044    2F             LIS1:  LBI    2,0    ;Last Eye Status was 1
84  0045    01                    SKMBZ  0      ;If latest eye status was 1,
85  0046    CA                    JP     NOICH  ;eye did not change
```

```
0047  35                YESICH: LD      3       ;Load latest eye status to A
                                                ;Point to RAM(1,0)
0048  06                        X               ;Save Latest Eye Status to
                                                ;Last Eye Status
0049  D1                        JP      SETFLAG ;Go ahead to Set Flags segment
004A  3E                NOICH:  LBI     3,15    ;No eye change--Point to Flag box
004B  01                        SKMBZ   0       ;If bit 0=1,Front Cut Flag set
004C  E4                        JP      CTTEST  ;Test Counter if FCF is set
004D  11                        SKMBZ   1       ;If bit1=1, Rear Cut Flag set
004E  E4                        JP      CTTEST  ;Test Counter if RCF is set
004F  60 9E             NOFLAG: JMP     TTEST   ;No flags up,go to wait for timer
0051  01                SETFLAG: SKMBZ  0       ;Test Latest Eye Status bit
                                                ;If latest Eye Status=0,skip FCF set
0052  DC                        JP      SETFCF
0053  33 B6             SETRCF: LBI     3,6     ;Point to Rear Cut Tens digit
0055  05                        LD              ;Bring to A
0056  5A                        AISC    10      ;Skip RCF set if RC Tens greater than 5
0057  D9                        JP      RCON    ;Rear Cut is On
0058  E4                        JP      CTTEST  ;RC is off, skip ahead
0059  3E                RCON:   LBI     3,15    ;Point to Flag box
005A  47                        SMB     1       ;Set rear Cut Flag
005B  E4                        JP      CTTEST  ;RCF is set, go ahead
005C  33 A6             SETFCF: LBI     2,6     ;Point to Front Cut Tens
005E  05                        LD              ;Bring to A
005F  5A                        AISC    10      ;Skip FCF set if FC Tens greater than 5
0060  E2                        JP      FCON    ;Front Cut is On
0061  E4                        JP      CTTEST  ;FC is off, go ahead
0062  3E                FCON:   LBI     3,15    ;Point to flag box
0063  4D                        SMB     0       ;Set Front Cut Flag
0064  1B                CTTEST: LBI     1,12    ;Point to RCC units
0065  35                        LD      3       ;Bring to A,point to RAM(2,12)
0066  21                        SKE             ;Test if RCC units=RCO+RC units
0067  FD                        JP      NORCM   ;Jump ahead if no match
0068  1C                        LBI     1,13    ;Point to RCC tens
0069  35                        LD      3       ;Bring to A,point to RAM(2,13)
006A  21                        SKE             ;Test if RCC tens=RCO+RC tens
006B  FD                        JP      NORCM   ;Jump ahead if no match
006C  1D                        LBI     1,14    ;point to RCC huns.
006D  35                        LD      3       ;Bring to A,point to RAM(2,14)
006E  21                        SKE             ;Test if RCC huns.=RCO+RC huns.
006F  FD                        JP      NORCM   ;Jump ahead if no match
0070  3E                RCM:    LBI     3,15    ;Match, point to flag box
0071  45                        RMB     1       ;Reset Rear Cut Flag
0072  1B                        LBI     1,12    ;Clear Rear Cut Counter
0073  00                        CLRA
0074  04                        XIS
0075  00                        CLRA
0076  04                        XIS
0077  00                        CLRA
0078  04                        XIS
0079  69 3C                     JSR     MATH    ;Do FC/RC Arithmetic
007B  6B 44                     JSR     RCUT    ;Rear Cut Sequence
007D  18                NORCM:  LBI     1,9     ;Test for Front Cut match
007E  35                        LD      3       ;Bring FC Units to A,point to RAM(2,9)
007F  21                        SKE             ;Test if FC Units=FCO-FC units
0080  96                        JP      INCCT   ;Jump ahaead if no match
0081  19                        LBI     1,10    ;Point to FC tens
0082  35                        LD      3       ;Bring to A,point to RAM(2,10)
0083  21                        SKE             ;Test if FC tens=FCO-FC tens
0084  96                        JP      INCCT   ;Jump ahead if no match
```

```
0085  1A                 LBI    1,11    ;Point to FC buns.
0086  35                 LD     3       ;Bring to A,point to FCD-FC buns.
0087  21                 SKE            ;Test if FC buns.=FCD-FC buns.
0088  96                 JP     INCCT   ;Jump ahead if no match
0089  3E           FCM:  LBI    3,15    ;Match;poit to flag box
008A  4C                 RMB    0       ;Reset Front Cut Flag
008B  18                 LBI    1,9     ;Clear Front Cut Counter
008C  00                 CLRA
008D  04                 XIS
008E  00                 CLRA
008F  04                 XIS
0090  00                 CLRA
0091  04                 XIS
0092  69 3C              JSR    MATH    ;Do FC/RC Arithmetic
0094  6B 3F              JSR    FCUT    ;Front Cut Sequence
0096  3E           INCCT: LBI   3,15    ;Point to flag box
0097  01                 SKMBZ  0       ;Skip if FCF not set
0098  69 03              JSR    INCFCC  ;Increment Front Cut Counter
009A  3E           TESTRCF: LBI 3,15    ;Point to flag box
009B  11                 SKMBZ  1       ;Skip if RCF not set
009C  69 04              JSR    INCRCC  ;Increment Rear Cut Counter
009E  6B 04        TTEST: JSR   TIMER   ;Speed Control Subroutine
00A0  60 1F              JMP    START   ;Go back to start and repeat
                   ;
                   ;***END OF MAIN PROGRAM***
                   ;
00A2  33 02        SEXIT: LBI   0,2     ;Preload B
00A4  33 3E              OBD            ;Turn on EXIT Pulse
00A6  00                 CLRA           ;Delay approx. 144uS
00A7  51           LUPE: AISC   1
00A8  A7                 JP     LUPE
00A9  0F                 LBI    0,0     ;Preload B for turn-off
00AA  33 3E              OBD            ;Turn off Exit Pulse
00AC  48                 RET
                         .PAGE
                   ;Place the following Subroutines on Page 3
                   ;
                   ;SUBROUTINE PWRCHK
                   ;Polls and processes Machine Power-Off Input
                   ;
00C0                     .ORG   00C0H
00C0  69 FB        PWRCHK: JSR  DISBNK  ;Turn off display
00C2  33 01        LOOP: SKGBZ  0       ;If GB=0,power is on
00C4  C2                 JP     LOOP    ;Wait for power-on
00C5  3F           PON:  LBI    3,0     ;Power is ON; point to Mode box
00C6  70                 STII   0       ;Put in Count/Halt mode
00C7  33 01              LBI    0,1     ;Preload B
00C9  33 3E              OBD            ;Turn on Strobe
00CB  44                 NOP
00CC  1F                 LBI    1,0     ;Point to Last Eye Status
00CD  33 28              ININ           ;Eye inputs to A
00CF  06                 X              ;Put into RAM
00D0  33 3E              OBD            ;Turn off Strobe
00D2  69 F3              JSR    CLRCNT  ;Reset Sheet Counter
00D4  69 70              JSR    DISUPD  ;Update display
                   ;
                   ;SUBROUTINE HALT
                   ;This routine goes to work when machine is halted by
                   ;either the Keyboard or Bale input
                   ;
```

```
206  00D6  33 01        HALT:   SKGBZ   0       ;Test Power input
207  00D8  C0                   JP      PWRCHK  ;Power is Off
208  00D9  41                   SKT             ;Test timer
209  00DA  E2                   JP      NKEY    ;Not timed out
210  00DB  3E                   LBI     3,15    ;Point to Flag Box
211  00DC  13                   SKMBZ   3       ;Does display need service ?
212  00DD  E0                   JP      DISNUP  ;Display needs updating
213  00DE  6A 40                JSR     KBDSVC  ;Service keyboard instead
214  00E0  69 78        DISNUP: JSR     DISUPD  ;Update display
215  00E2  3F           NKEY:   LBI     3,0     ;Point to Mode box
216  00E3  03                   SKMBZ   2       ;Test Run/Stop bit 0=Stop 1=Run
217  00E4  E6                   JP      NEXT1   ;No skip means RUN
218  00E5  D6                   JP      HALT    ;Machine Halt
219  00E6  33 03        NEXT1:  SKGBZ   2       ;Test Bale Input 0=Halt 1=Run
220  00E8  EA                   JP      NEXT2   ;No skip means Run
221  00E9  D6                   JP      HALT    ;Loop until bale halt is off
222  00EA  69 3C        NEXT2:  JSR     MATH    ;Do FC/RC Arithmetic
223  00EC  48                   RET
224                     ;
225                     ;SUBROUTINE SPDUP
226                     ;SPDUP first increments the Binary Speed "Shadow" Counter
227                     ;Then goes ahead to increment the BCD (display) counter
228                     ;
229  00ED  23 13        SPDUP:  LDD     1,3
230  00EF  51                   AISC    1
231  00F0  F9                   JP      NOCARY
232  00F1  23 93                XAD     1,3
233  00F3  23 94                XAD     1,4
234  00F5  51                   AISC    1
235  00F6  23 94                XAD     1,4
236  00F8  FB                   JP      INCSPD
237  00F9  23 93        NOCARY: XAD     1,3
238                     ;
239                     ;SUBROUTINE INC
240                     ;Subroutine to increment various RAM counters
241                     ;
242  00FB  33 95        INCSPD: LBI     1,5     ;Entry Pt. to incr. Speed setting
243  00FD  33 A5        INCFC:  LBI     2,5     ;Entry pt. to incr. Front Cut
244  00FF  33 B5        INCRC:  LBI     3,5     ;Entry pt. to incr. Rear Cut
245  0101  22                   SC
246  0102  D4                   JP      ADD2    ;Add 2 BCD digits
247  0103  18           INCFCC: LBI     1,9
248  0104  1B           INCRCC: LBI     1,12
249  0105  22                   SC
250  0106  CF                   JP      ADD3
251  0107  33 85        INCSC:  LBI     0,5     ;Entry pt. to incr. Sheet Counter
252  0109  22                   SC
253  010A  00                   CLRA
254  010B  56                   AISC    6
255  010C  30                   ASC
256  010D  4A                   ADT
257  010E  04                   XIS
258  010F  00           ADD3:   CLRA
259  0110  56                   AISC    6
260  0111  30                   ASC
261  0112  4A                   ADT
262  0113  04                   XIS
263  0114  00           ADD2:   CLRA
264  0115  56                   AISC    6
265  0116  30                   ASC
```

```
266  0117  4A                    ADT
267  0118  84                    XIS
268  0119  00                    CLRA
269  011A  30                    ASC
270  011B  06                    X
271  011C  48                    RET
272                         ;
273                         ;SUBROUTINE SPDDN
274                         ;Subroutine to decrement to Speed Binary "Shadow" Counter
275                         ;Then jump ahead to decrement the BCD (display) counter
276                         ;
277  011D  23 13            SPDDN: LDD    1,3
278  011F  5F                    AISC   15
279  0120  E4                    JP     MORE
280  0121  23 93                 XAD    1,3
281  0123  EC                    JP     DECSPD
282  0124  23 93            MORE:  XAD    1,3
283  0126  23 94                 XAD    1,4
284  0128  5F                    AISC   15
285  0129  44                    NOP
286  012A  23 94                 XAD    1,4
287                         ;
288                         ;SUBROUTINE DEC
289                         ;Subroutine to decrement a BCD RAM Counter
290                         ;
291  012C  33 95            DECSPD: LBI   1,5    ;Entry pt. to decr. Speed setting
292  012E  33 A5            DECFC:  LBI   2,5    ;Entry pt. to decr. Front Cut
293  0130  33 B5            DECRC:  LBI   3,5    ;Entry pt. to decr. Rear Cut
294  0132  32                    RC
295  0133  00                    CLRA
296  0134  10                    CASC
297  0135  4A                    ADT
298  0136  84                    XIS
299  0137  00                    CLRA
300  0138  10                    CASC
301  0139  44                    NOP
302  013A  06                    X
303  013B  48                    RET
304                         ;
305                         ;SUBROUTINE MATH
306                         ;Subroutine to calculate Rear Cut Offset + Rear Cut
307                         ;Front Cut Offset - Front Cut from current RAM values
308                         ;
309  013C  3B               MATH:  LBI    3,12
310        00 01                   RCOU:  EQUAL  1
311        00 09                   RCOT:  EQUAL  9
312        00 02                   RCOH:  EQUAL  2
313  013D  71                    STII   RCOU
314  013E  79                    STII   RCOT
315  013F  72                    STII   RCOH
316  0140  2D                    LBI    2,14
317  0141  00                    CLRA
318  0142  06                    X
319  0143  33 B6                 LBI    3,6
320  0145  05                    LD
321  0146  2C                    LBI    2,13
322  0147  06                    X
323  0148  33 B5                 LBI    3,5
324  014A  05                    LD
325  014B  2B                    LBI    2,12
```

```
326  014C  16                    X       1
327  014D  32              BCDADD: RC
328  014E  15              ADDL:   LD      1
329  014F  56                      AISC    6
330  0150  30                      ASC
331  0151  4A                      ADT
332  0152  14                      XIS     1
333  0153  4E                      CBA
334  0154  51                      AISC    1
335  0155  CE                      JP      ADDL
336  0156  28                      LBI     2,9
337        00 01                   FCOU:   EQUAL   1
338        00 09                   FCOT:   EQUAL   9
339        00 02                   FCOH:   EQUAL   2
340  0157  71                      STII    FCOU
341  0158  79                      STII    FCOT
342  0159  72                      STII    FCOH
343  015A  3A                      LBI     3,11
344  015B  00                      CLRA
345  015C  06                      X
346  015D  33 A6                   LBI     2,6
347  015F  05                      LD
348  0160  39                      LBI     3,10
349  0161  06                      X
350  0162  33 A5                   LBI     2,5
351  0164  05                      LD
352  0165  38                      LBI     3,9
353  0166  06                      X
354  0167  22              BCDSUB: SC
355  0168  15              SUB:    LD      1
356  0169  10                      CASC
357  016A  4A                      ADT
358  016B  14                      XIS     1
359  016C  4E                      CBA
360  016D  54                      AISC    4
361  016E  E8                      JP      SUB
362  016F  40                      RET
363                        ;
364                        ;SUBROUTINE DISUPD
365                        ;Subroutine to update display by sending data out
366                        ;the serial port to MM5450N Display Driver
367                        ;
368  0170  3E              DISUPD: LBI     3,15    ;Point to Flag Box
369  0171  43                      RMB     3       ;Reset "Disp. Needs Svc." Flag
370  0172  3F                      LBI     3,8     ;Point to Mode Box
371  0173  05                      LD              ;Bring to A
372  0174  33 B8                   LBI     8,8     ;point to "Units" digit column
373  0176  12                      XABR            ;Point to actual digit to send
374  0177  05              DIS:    LD              ;Bring Thous digit to A
375  0178  07                      XDS             ;Bring Thous to A, point to huns
376  0179  23 BF                   XAD     8,15    ;Put Thous in Disp Work Area (DWA)
377  017B  05                      LD              ;Bring Huns to A
378  017C  07                      XDS             ;Bring huns to A, point to tens
379  017D  23 BE                   XAD     8,14    ;Put Huns in DWA
380  017F  05                      LD              ;Bring Tens to A
381  0180  07                      XDS             ;Bring Tens to A, point to units
382  0181  23 BD                   XAD     8,13    ;Put Tens in DWA
383  0183  05                      LD              ;Bring Units to A
384  0184  0B                      LBI     8,12    ;Point to units of DWA
```

```
385  0185  06                    X          ;Put Units in DWA,B points to RAM(0,12)
386  0186  00              PACK1: CLRA
387  0187  5C                    AISC   12  ;Flip to page 3 for lookup
388  0188  0F                    LQID       ;Segment data to Q
389  0189  33 2C                 COMA       ;Q7-4 to RAM(0,12), Q3-0 to A
390  018B  22                    SC         ;Set carry for sync
391  018C  4F                    XAS        ;Exch. A with SIO and start data flow
392  018D  44                    NOP        ;Start bit is embedded in table data
393  018E  44                    NOP        ;Wait 4 cycles then bring next 4 bits
394  018F  05                    LD         ;to A
395  0190  4F                    XAS        ;Exchange for next 4 bits
396  0191  44                    NOP        ;Wait 4 more cycles
397  0192  44                    NOP
398  0193  32                    RC         ;Reset carry to stop sync
399  0194  4F                    XAS        ;Stop sync--First 8 bits sent
400  0195  0C                    LBI    0,13 ;Point to tens digit
401  0196  00              THRPAX: CLRA     ;This loop sends 7 bits three times
402  0197  5D                    AISC   13  ;Flip to page 3 for lookup
403  0198  0F                    LQID       ;Segment data to Q
404  0199  33 2C                 COMA
405  019B  22                    SC
406  019C  4F                    XAS
407  019D  44                    NOP
408  019E  44                    NOP        ;The three 7-bit packets represent the
409  019F  05                    LD         ;Tens,Hundreds,and Thousands digit
410  01A0  4F                    XAS        ;in that order.
411  01A1  44                    NOP        ;Wait only three cycles this time
412  01A2  32                    RC         ;so that seven bits only are sent
413  01A3  4F                    XAS        ;After this group,21+8=29bits have been sent
414  01A4  04                    XIS        ;Skip after Thous. have been sent,
415  01A5  D6                    JP     THRPAX ;otherwise go back
416  01A6  3F              LASPAX: LBI    3,0 ;To send last 7 bits, point to Mode box
417  01A7  00                    CLRA       ;and get data for Mode LED's
418  01A8  5E                    AISC   14  ;Flip to page 3 for lookup
419  01A9  0F                    LQID       ;LED data to Q
420  01AA  0F                    LBI    0,0 ;Point to scratchpad area
421  01AB  33 2C                 COMA       ;Q7-4 to RAM(0,0) Q3-0 to A
422  01AD  22                    SC
423  01AE  4F                    XAS        ;Last 7 bits sent represent the six
424  01AF  44                    NOP        ;Mode LED's plus the 36th bit,
425  01B0  44                    NOP        ;which is a dummy bit for MM5450N
426  01B1  05                    LD
427  01B2  4F                    XAS        ;Laspax sends 7 bits so that Disupd
428  01B3  44                    NOP        ;always sends a stream of 36 total bits
429  01B4  32                    RC
430  01B5  4F                    XAS        ;Stop sync, 36th bit sent
431  01B6  48                    RET        ;Done
432                              .PAGE
433                         ;Page 7 has Lookup data for the various segments of DISUPD
434                         ;Subroutine. Table starts on page 7 first byte.
435                         ;
436  01C0                        .ORG   01C0H
437  01C0  EF                    .BYTE  EFH
438  01C1  0B                    .BYTE  0BH
439  01C2  DE                    .BYTE  DEH
440  01C3  9F                    .BYTE  9FH
441  01C4  3B                    .BYTE  3BH
442  01C5  BD                    .BYTE  BDH
443  01C6  FD                    .BYTE  FDH
444  01C7  0F                    .BYTE  0FH
```

```
445  01C8  FF                    .BYTE   FFH
446  01C9  BF                    .BYTE   BFH
447  01CA  08                    .BYTE   08H
448  01CB  7C                    .BYTE   7CH
449  01CC  18                    .BYTE   18H
450                           ;Data for THRPAX segment
451  01D0                        .ORG    01D0H
452  01D0  CF                    .BYTE   CFH
453  01D1  86                    .BYTE   86H
454  01D2  AD                    .BYTE   ADH
455  01D3  2F                    .BYTE   2FH
456  01D4  66                    .BYTE   66H
457  01D5  6B                    .BYTE   6BH
458  01D6  EB                    .BYTE   EBH
459  01D7  0E                    .BYTE   0EH
460  01D8  EF                    .BYTE   EFH
461  01D9  6F                    .BYTE   6FH
462  01DA  00                    .BYTE   00H
463  01DB  E0                    .BYTE   E0H
464  01DC  20                    .BYTE   20H
465                           ;Data for LASPAX segment
466  01E0                        .ORG    01E0H
467  01E0  88                    .BYTE   88H
468  01E1  84                    .BYTE   84H
469  01E2  82                    .BYTE   82H
470  01E3  81                    .BYTE   81H
471  01E4  48                    .BYTE   48H
472  01E5  44                    .BYTE   44H
473  01E6  42                    .BYTE   42H
474  01E7  41                    .BYTE   41H
475  01E8  00                    .BYTE   00H
476                              .PAGE
477                           ;SUBROUTINE CLRAM
478                           ;Subroutine to clear all RAM on power-up
479                           ;
480  01EA                        .ORG    01EAH
481  01EA  3E                 CLRAM: LBI     3,15
482  01EB  00                 CLR:   CLRA
483  01EC  07                        IDS
484  01ED  ED                        JP      CLR
485  01EE  12                        IABR
486  01EF  5F                        AISC    15
487  01F0  48                        RET
488  01F1  12                        IABR
489  01F2  ED                        JP      CLR
490                           ;
491                           ;SUBROUTINE CLRCNT
492                           ;Subroutine to clear a 4-digit RAM Counter(Sheet Counter)
493                           ;@ RAM(0,5) thru (0,8)
494                           ;
495  01F3  33 05              CLRCNT: LBI    0,5
496  01F5  00                 CLRC:  CLRA
497  01F6  04                        IIS
498  01F7  4E                        CBA
499  01F8  57                        AISC    7
500  01F9  F5                        JP      CLRC
501  01FA  48                        RET
502                           ;
503                           ;SUBROUTINE     DISBNK
```

```
                        ;This subroutine outputs all zeros via serial port
                        ;to blank the display
                        ;
01FB  00                DISBNK: CLRA
01FC  58                        AISC    8
01FD  22                        SC
01FE  4F                        IAS
01FF  00                        CLRA
0200  51                LOOPD:  AISC    1
0201  C0                        JP      LOOPD
0202  44                        NOP
0203  32                        RC
0204  4F                        IAS
0205  48                        RET
                                .PAGE
                        ;SUBROUTINE KBDSVC
                        ;Subroutine to decode and process the keyboard
                        ;
                        ;Place this code on Page 8
                        ;Page 8 contains "JID" table data for keyboard decode
0207                            .ORG    0207H
0207  7E                        .BYTE   7EH     ;Address of SKIP
0208  FF                        .BYTE   FFH     ;Dummy
0209  FF                        .BYTE   FFH     ;Dummy
020A  FF                        .BYTE   FFH     ;Dummy
020B  7E                        .BYTE   7EH     ;Address of SKIP
020C  FF                        .BYTE   FFH     ;Dummy
020D  5E                        .BYTE   5EH     ;Address of MODEKEY
020E  58                        .BYTE   58H     ;Address of RSKEY
0217                            .ORG    0217H
0217  6E                        .BYTE   6EH     ;Address of UPSPD
0218  FF                        .BYTE   FFH
0219  FF                        .BYTE   FFH
021A  FF                        .BYTE   FFH
021B  7A                        .BYTE   7AH     ;Address of DWNSPD
021C  FF                        .BYTE   FFH
021D  5E                        .BYTE   5EH     ;Address of MODEKEY
021E  58                        .BYTE   58H     ;Address of RSKEY
0227                            .ORG    0227H
0227  6B                        .BYTE   6BH     ;Address of UPFC
0228  FF                        .BYTE   FFH
0229  FF                        .BYTE   FFH
022A  EF                        .BYTE   FFH
022B  74                        .BYTE   74H     ;Address of DWNFC
022C  FF                        .BYTE   FFH
022D  5E                        .BYTE   5EH     ;Address of MODEKEY
022E  58                        .BYTE   58H     ;Address of RSKEY
0237                            .ORG    0237H
0237  71                        .BYTE   71H     ;Address of UPRC
0238  FF                        .BYTE   FFH
0239  FF                        .BYTE   FFH
023A  FF                        .BYTE   FFH
023B  77                        .BYTE   77H     ;Address of DWNRC
023C  FF                        .BYTE   FFH
023D  5E                        .BYTE   5EH     ;Address of MODEKEY
023E  58                        .BYTE   58H     ;Address of RSKEY
                                .PAGE
```

```
                        ;Place following code on Page 9
                        ;This is the actual KBDSVC Subroutine
                        ;
0240                    .ORG    0240H
0240  0F                KBDSVC: LBI     0,0     ;Point to scratchpad area
0241  33 2E                     INL             ;L7-4 to RAM(0,0) L3-0 to A
0243  51                        AISC    1       ;Skip if no keys down
0244  CB                        JP      KEYDWN
0245  2E                RSKBC:  LBI     2,15    ;Reset KBC
0246  06                        X
0247  49                        RETSK
0248  2E                KEYDWN: LBI     2,15    ;Skip if Kbd is NOT disabled
0249  13                        SKMBZ   3
024A  49                        RETSK
024B  05                KBWD:   LD              ;Bring KBC to A
024C  51                        AISC    1       ;Increment
024D  06                        X               ;Return to RAM
024E  03                        SKMBZ   2       ;Skip if NOT ready
024F  D1                        JP      SETKBD  ;Set keyboard disable
0250  49                        RETSK
0251  48                SETKBD: SMB     3       ;
0252  3F                KEYDEC: LBI     3,0     ;Point to Mode box
0253  05                        LD              ;Bring to A
0254  12                        XABR            ;Put lower two bits of Mode box
0255  12                        XABR            ;in A, 0 to A3 and A2
0256  0F                        LBI     0,0     ;Point to stored switch inputs
0257  FF                        JID             ;Jump indirect (via table) to routine
                                                ;to process the active keyswitch
0258  3F                RSKEY:  LBI     3,0     ;Run/Stop key depressed-Point to Mode box
0259  08                        CLRA
025A  54                        AISC    4       ;Make mask "0100"
025B  02                        XOR             ;Toggle Run/Stop bit
025C  06                        X               ;Put back in RAM
025D  FC                        JP      SDNSF   ;Jump to set "Disp needs Svc" flag
025E  3F                MODEKEY: LBI    3,0     ;Mode key is pressed-Point to Mode box
025F  08                        CLRA            ;Increment Mode value
0260  51                        AISC    1
0261  31                        ADD
0262  03                        SKMBZ   2       ;Test bit 2 (Run/Stop),skip if zero
0263  E7                        JP      SET     ;Make sure bit 2 is set (don't change)
0264  06                        X               ;Put incr. mode counter back in RAM
0265  42                        RMB     2       ;Reset bit 2 if nec.
0266  FC                        JP      SDNSF   ;Jump to set "Disp needs Svc" Flag
0267  06                SET:    X
0268  46                        SMB     2       ;Set bit 2 if nec.
0269  43                        RMB     3       ;Be sure bit 3 wasn't incremented
026A  FC                        JP      SDNSF   ;Jump to set "Disp needs Svc" flag
026B  6B FD             UPFC:   JSR     INCFC   ;UP pushed in Front Cut mode
026D  FC                        JP      SDNSF
026E  6B ED             UPSPD:  JSR     SPDUP   ;UP pushed in Speed Mode
0270  FC                        JP      SDNSF
0271  6B FF             UPRC:   JSR     INCRC   ;UP pushed in Rear Cut mode
0273  FC                        JP      SDNSF
0274  69 2E             DWNFC:  JSR     DECFC   ;DOWN pushed in Front Cut mode
0276  FC                        JP      SDNSF
0277  69 30             DWNRC:  JSR     DECRC   ;DOWN pushed in Rear Cut mode
0279  FC                        JP      SDNSF
027A  69 1D             DWNSPD: JSR     SPDDN
027C  3E                SDNSF:  LBI     3,15    ;Point to Flag box
```

```
620  027D  4B                        SMB    3        ;Set "Display Needs Service" flag
621  027E  49                 SKIP:  RETSK           ;This table entry point lets program
622                                                   ;ignore Up/Down keys in Counter mode
623  02FF                            .ORG 02FFH
624  02FF  49                        RETSK            ;Throw back multiple key depressions
625                                                   ;accessed by wayward table jumps
626                                  .PAGE
627                       ;SUBROUTINE TIMER
628                       ;Subroutine to generate a variable delay depending on SPEED setting
629                       ;Uses Speed Binary "Shadow" Counter to generate delays from 28uS
630                       ;to 7mS for Speed settings of 63 to 00 in RAM
631                       ;
632  0300  08                        .BYTE  08H      ;Address of DLY1
633  0301  0E                        .BYTE  0EH      ;Address of DLY2
634  0302  14                        .BYTE  14H      ;Address of DLY3
635  0303  1A                        .BYTE  1AH      ;Address of DLY4
636  0304  00                 TIMER: CLRA
637  0305  33 94                     LBI    1,4
638  0307  FF                        JID
639  0308  23 13              DLY1:  LDD    1,3
640  030A  33 13              MUTS2U: SKGBZ  3
641  030C  CA                        JP     MUTS2U
642  030D  E8                        JP     DLYA
643  030E  23 13              DLY2:  LDD    1,3
644  0310  33 13              MUTS2U2:SKGBZ  3
645  0312  D0                        JP     MUTS2U2
646  0313  EA                        JP     DLYB
647  0314  23 13              DLY3:  LDD    1,3
648  0316  33 13              MUTS2U3:SKGBZ  3
649  0318  D6                        JP     MUTS2U3
650  0319  F2                        JP     DLYC
651  031A  23 13              DLY4:  LDD    1,3
652  031C  33 13              MUTS2U4:SKGBZ  3
653  031E  DC                        JP     MUTS2U4
654  031F  FA                        JP     DLYD
655  0320  23 B9              DLYA:  XAD    8,9
656  0322  44                 DLYALP: NOP
657  0323  44                        NOP
658  0324  51                        AISC   1
659  0325  E2                        JP     DLYALP
660  0326  23 B9                     XAD    8,9
661  0328  51                        AISC   1
662  0329  E8                        JP     DLYA
663  032A  23 B9              DLYB:  XAD    8,9
664  032C  51                 DLYBLP: AISC   1
665  032D  EC                        JP     DLYBLP
666  032E  23 B9                     XAD    8,9
667  0330  51                        AISC   1
668  0331  EA                        JP     DLYB
669  0332  44                 DLYC:  NOP
670  0333  44                        NOP
671  0334  44                        NOP
672  0335  44                        NOP
673  0336  44                        NOP
674  0337  44                        NOP
675  0338  51                        AISC   1
676  0339  F2                        JP     DLYC
677  033A  44                 DLYD:  NOP
678  033B  44                        NOP
679  033C  51                        AISC   1
```

```
033D  FA                JP      DLYD
033E  48                RET
                        .PAGE
                ;SUBROUTINES FCUT, RCUT
                ;Subroutines to control the Cut sequence when called
                ;by the Main Program
                ;
033F  33 B6     FCUT:   LBI     3,6     ;Point to RC tens digit
0341  85                LD              ;Bring to A
0342  5A                AISC    10      ;Skip if RC greater than 59
0343  C6                JP      CUT     ;No skip means RC on--don't incr. counter
0344  69 87     RCUT:   JSR     INCSC   ;Increment Sheet Counter
0346  33 11     CUT:    SKGBZ   1       ;Check for Blade Ready signal
0348  CA                JP      CUTNOW  ;Blade is ready
0349  C6                JP      CUT     ;Wait for blade ready (loop)
034A  3E        CUTNOW: LBI     3,15
034B  42                RMB     2       ;Clear Top Sw. Present Flag
034C  33 81             LBI     8,1     ;Clear TSCC, BSCC
034E  70                STII    0
034F  70                STII    0
0350  09                LBI     8,10    ;Clear Timer Counter
0351  70                STII    0
0352  70                STII    0
0353  33 88             LBI     8,8     ;Load 8 to turn on Shear, EFSS
0355  33 3E             OBD             ;Turn on Shear
0357  0F        LOOP5:  LBI     8,0     ;Point to scratchpad area
0358  33 28             ININ            ;Read inputs (Top sw=IN2 Bot sw=IN3)
035A  86                X               ;Put in RAM(8,0)
035B  83                SKMBZ   2       ;Skip if I2 was 0 (Top sw open)
035C  E1                JP      INCTSC  ;No skip=Top Sw closed
035D  33 82     CLRTSC: LBI     8,2     ;Clear TSCC
035F  70                STII    0
0360  E9                JP      POLLBS  ;Jump ahead to poll Bot. Sw.
0361  23 82     INCTSC: XAD     8,2     ;Bring TSCC to A
0363  51                AISC    1       ;Increment, skip if full
0364  E7                JP      CCNF    ;Counter not full
0365  3E                LBI     3,15    ;Counter full;set Top Sw present flag
0366  46                SMB     2
0367  23 82     CCNF:   XAD     8,2     ;Put incr. TSCC back in RAM
0369  0F        POLLBS: LBI     8,0     ;Point to scratchpad area
036A  13                SKMBZ   3       ;Skip if I3 was 0 (Bot sw open)
036B  F8                JP      INCBSC  ;I3 was 1 (Bot sw closed)-incr. BSCC
036C  33 81     CLRBSC: LBI     8,1     ;Clear BSCC
036E  70                STII    0
036F  F8                JP      TESTIM  ;Go ahead to test timer
0370  23 81     INCBSC: XAD     8,1     ;Bring BSCC to A
0372  51                AISC    1       ;Increment BSCC
0373  F6                JP      NUTS    ;BSCC not full
0374  63 BE             JMP     ENDCUT  ;BSCC full--Downstroke done
0376  23 81     NUTS:   XAD     8,1     ;Put incr. BSCC back in RAM
0378  41        TESTIM: SKT             ;Test timer
0379  87                JP      LOOP5   ;Timer not set, go back
037A  23 8A     INCTC:  XAD     8,10    ;Increment Timer Counter
037C  51                AISC    1
037D  63 86             JMP     AHEAD1
037F  23 8A             XAD     8,10
0381  23 8B             XAD     8,11
0383  54                AISC    4
0384  CA                JP      DUMMY
0385  CE                JP      ENDCUT
```

```
740  0386  23 8A
741  0388  63 57
742  038A  23 8B
743  038C  63 57
744  038E  0F
745  038F  33 3E
746  0391  3E
747  0392  83
748  0393  B7
749  0394  6B B8
750  0396  E9
751  0397  6B B5
752  0399  33 82
753  039B  70
754  039C  0F
755  039D  33 28
756  039F  86
757  03A0  13
758  03A1  E3
759  03A2  D9
760  03A3  23 82
761  03A5  51
762  03A6  EF
763  03A7  6B B2
764  03A9  69 78
765  03AB  68 A2
766  03AD  40
767  03AE  44
768  03AF  23 82
769  03B1  DC
770  03B2  00
771  03B3  5F
772  03B4  FD
773  03B5  00
774  03B6  5E
775  03B7  FD
776  03B8  00
777  03B9  5C
778  03BA  FD
779  03BB  00
780  03BC  58
781  03BD  09
782  03BE  70
783  03BF  86
784  03C0  41
785  03C1  C0
786  03C2  23 8A
787  03C4  51
788  03C5  C0
789  03C6  23 8A
790  03C8  23 8B
791  03CA  51
792  03CB  D1
793  03CC  40
794  03CD  23 8A
795  03CF  63 C0
796  03D1  23 8B
797  03D3  63 C0
798
```

```
AHEAD1: XAD    0,10
        JMP    LOOP5
DUMMY:  XAD    0,11
        JMP    LOOP5
ENDCUT: LBI    0,8      ;Load B to turn off Shear, EFSS on
        OBD             ;Turn off shear
TSTTSF: LBI    3,15     ;Test Top Sw present Flag
        SKMBZ  2        ;Skip if Top Sw is not present
        JP     TSP      ;Top Sw is present
        JSR    DLY512   ;Top Sw missing--delay 512mS
        JP     FINIS    ;Almost done
TSP:    JSR    DLY128   ;Top Sw is present--delay 128mS
CCC:    LBI    0,2      ;Clear TSCC
        STII   0
LOOP6:  LBI    0,8      ;point to scratchpad area
        ININ            ;Read IN inputs
        X               ;Put into RAM
        SKMBZ  3        ;Skip if Top Sw open
        JP     NERD     ;Top Sw is closed
        JP     CCC      ;Clear Top Sw counter
NERD:   XAD    0,2      ;Bring TSCC to A
        AISC   1        ;Increment TSCC, skip if full
        JP     GOOF     ;TSCC not full
        JSR    DLY64    ;TSCC full--Delay 64mS
FINIS:  JSR    DISUPD   ;Update display before returning
        JSR    SEXIT    ;Send Exit Pulse for Blade Controller
        RET
        NOP
GOOF:   XAD    0,2      ;Put incr. TSCC back in RAM
        JP     LOOP6
DLY64:  CLRA            ;Preset A to 15
        AISC   15
        JP     DLY
DLY128: CLRA            ;Preset A to 14
        AISC   14
        JP     DLY
DLY256: CLRA            ;Preset A to 12
        AISC   12
        JP     DLY
DLY512: CLRA            ;Preset A to 8
        AISC   8
DLY:    LBI    0,10     ;Point to low byte Timer Counter
        STII   0        ;Clear RAM(0,10),point to (0,11)
        X               ;Store A preset in RAM(0,11)
LOOP3:  SKT             ;Test Time base counter
        JP     LOOP3
        XAD    0,10     ;Bring RAM(0,10) to A
        AISC   1        ;Incr. A
        JP     LOOP4
        XAD    0,10     ;Put 0 back in RAM
        XAD    0,11     ;Retrieve high order byte
        AISC   1        ;Incr. High order byte,skip if full
        JP     DUMMY1
        RET
LOOP4:  XAD    0,10
        JMP    LOOP3
DUMMY1: XAD    0,11
        JMP    LOOP3
        .PAGE
```

```
799                          ;SUBROUTINE HLTCHK
800                          ;Subroutine to poll Bale Halt, Machine Halt and Front/Rear Cut
801                          ;Flags to see if EFSS is required, or if Halt is needed, to
802                          ;give EFSS enough time to slow machine before halting
803                          ;
804  03D5  33 03                 HLTCHK: SKGBZ   2       ;Poll Bale Halt input
805  03D7  D9                            JP      NBHLT   ;No Bale Halt needed
806  03D8  E9                            JP      INCHC   ;Bale Halt called-- incr. counter
807  03D9  3F                     NBHLT: LBI     3,0     ;Point to Mode box
808  03DA  03                            SKMBZ   2       ;Test for Machine halt
809  03DB  DD                            JP      NOHLT   ;No Machine halt
810  03DC  E9                            JP      INCHC   ;Machine halt-- incr. counter
811  03DD  3E                     NOHLT: LBI     3,15    ;No Halt called, check FC/RC Flags
812  03DE  01                            SKMBZ   0       ;Skip if FCF not set
813  03DF  F7                            JP      SETEFSS ;FCF is set-- set EFSS
814  03E0  11                            SKMBZ   1       ;Skip if RCF not set
815  03E1  F7                            JP      SETEFSS ;RCF is set-- set EFSS
816  03E2  1E                     RSEFSS: LBI    1,15    ;Reset EFSS flag
817  03E3  46                            SMB     2
818  03E4  33 03                  RSHC:   LBI    0,3     ;Point to Halt Counter
819  03E6  70                            STII    0       ;Clear Halt Counter
820  03E7  70                            STII    0
821  03E8  48                            RET
822  03E9  23 03                  INCHC:  XAD    0,3     ;Bring Halt Counter to A
823  03EB  51                            AISC    1       ;Increment
824  03EC  F5                            JP      LOOP7   ;No carry to 0,4
825  03ED  23 03                         XAD    0,3     ;Return to RAM, restore A
826  03EF  23 04                         XAD    0,4     ;Bring HC MSB to A
827  03F1  51                            AISC    1       ;Incr. MSB
828  03F2  23 04                         XAD    0,4     ;Store MSB, restore A
829  03F4  F7                            JP      SETEFSS ;Go on
830  03F5  23 03                  LOOP7:  XAD    0,3     ;Put back LSB
831  03F7  1E                     SETEFSS:LBI    1,15    ;Point to Output Work area
832  03F8  42                            RMB     2       ;Set EFSS flag
833  03F9  33 04                  RTH:    LBI    0,4     ;Point to Halt Ctr. MSB
834  03FB  03                            SKMBZ   2       ;Delay 64 counts or 256mS
835  03FC  60 D6                         JMP     HALT    ;Go to HALT routine
836  03FE  48                            RET
837  03FF                         .END
```

We claim:

1. Article position control apparatus responsive to an offset angle between an straight edge of an article and a first reference line comprising:

a pair of spaced apart sensing means located along a second line;

moving means for moving the article in a direction at right angles to said reference line to bring said article straight edge to and past said pair of sensing means, whereby said article straight edge will reach said pair of sensing means at the same time when said article straight edge is parallel to said second line and will reach said pair of sensing means sequentially if said straight edge is at an angle to said second line;

means responsive to the sequence in time when said straight edge of said sheet initially reaches said pair of sensing means for producing an article straight edge angle indicating signal which varies with the time sequence;

and adjusting means responsive to said article straight edge angle indicating signal for adjusting the relative positions of said article straight edge and said reference line so that said straight edge and said reference line have a substantially constant predetermined relationship.

2. The apparatus of claim 1 combined with a cutting blade having a cutting plane positioned along said first reference line, said adjusting means adjusting the angle of one of said article straight edge and blade so that said article straight edge is parallel to said cutting plane;

said moving means including means for bringing said article straight edge into cutting position at said cutting plane after said adjusting means has completed the aforementioned adjustment;

and means for bringing at least one of said blade and said article straight edge against the other to sever the article along said straight edge.

3. The apparatus of claims 1 or 2 wherein said adjusting means produces a signal which is a direct measure of the sequence in time said straight edge reaches said pair of sensing means.

4. The apparatus of claims 1 or 2 wherein said pair of sensing means each comprise a light source, a light sensor and a slot between said source and sensor which is evenly radiated by the light from the associated light source, each sensor producing a linearly varying output as the edge involves progressively passes along said slot, said adjusting means including means for measuring the relative amount of light passing through said slots at an instant of time said slots are partially covered by the article.

5. Apparatus responsive to the offset angle between a straight edge of an article and a first reference line:

means forming a pair of similar slots spaced along a second line, said slots being transparent to a given radiation and said means beyond said slots being opaque to said radiation;

radiation source means on one side of said slots for directing said radiation through said slots;

a pair of radiation sensing means on the opposite side of said slots for generating output analog signals proportional to the overall amount of the radiation passing through said slots and received by each of said sensing means;

moving means for moving said article straight edge toward and beyond said pair of slots in a direction transverse to said second line so that the article progressively decreases to zero the amount of radiation received by said radiation sensing means;

comparison means for comparing the signals indicative of the amplitudes of said output analog signals generated by said radiation sensing means at an instant of time when said straight edge intercepts the radiation passing through both of said slots and generating a comparison signal indicative of said compared signals; and adjusting means responsive to said comparison signal for adjusting the relative positions of said article straight edge and said reference line to a given predetermined relationship.

6. The apparatus of claim 5 wherein said comparison means makes signal comparison at the instant of time when the article straight edge reaches a middle position of one of the slots first reached by said article straight edge.

7. The apparatus of claim 5 wherein said analog signals of said pair of radiation sensing means producing different error analog signals when receiving radiation from the entire areas of the associated slots than when the radiation intensity of said pair of radiation source means generate different magnitudes of radiation;

normalizing means for correcting a comparison error produced by said error analog signals by modifying the analog outputs of said sensing means, said normalizing means including means for storing a reference maximum radiation value for idealizing the analog outputs of said radiation sensing means when an idealized radiation source directs its radiation through the entire areas of the associated slots, means for measuring the current maximum analog output signal of each of said pair of radiation sensing means when radiation from the entire associated slot area is detected thereby, and means responsive to said stored reference maximum radiation value and the current maximum analog signal for generating from the output of said sensing means a modified signal which more closely approximates a signal which would be obtained if the value represented by said current maximum analog output signal corresponded to said stored reference maximum radiation value.

8. The apparatus of claim 1 or 5 combined with a cutting blade having a cutting plane positioned along said first reference line, said adjusting means adjusting the angular position of one of said article straight edge and blade so that said article straight edge is parallel to said cutting plane;

said moving means including means for bringing said article straight edge into cutting position at said cutting plane after said adjusting means has completed the aforementioned adjustment;

and means for bringing at least one of said blade and said article straight edge against the other to sever the article at or adjacent said straight edge.

* * * * *